US011472148B2

(12) United States Patent
Tan

(10) Patent No.: US 11,472,148 B2
(45) Date of Patent: Oct. 18, 2022

(54) SELF OPENING WIDE MOUTH CARRYOUT BAG PACK, APPARATUS AND METHOD OF MAKING SAME

(71) Applicant: Gregorio Lim Tan, Harahan, LA (US)

(72) Inventor: Gregorio Lim Tan, Harahan, LA (US)

( * ) Notice: Subject to any disclaimer, the term of this patent is extended or adjusted under 35 U.S.C. 154(b) by 197 days.

(21) Appl. No.: 17/029,647

(22) Filed: Sep. 23, 2020

(65) Prior Publication Data

US 2021/0001584 A1 Jan. 7, 2021

Related U.S. Application Data

(60) Division of application No. 16/132,370, filed on Sep. 15, 2018, now Pat. No. 10,814,577, which is a (Continued)

(51) Int. Cl.
*B31B 70/14* (2017.01)
*B65D 33/00* (2006.01)

(Continued)

(52) U.S. Cl.
CPC ..... *B31B 70/14* (2017.08); *B65D 33/001* (2013.01); *B65D 33/007* (2013.01); *B31B 70/16* (2017.08); *B31B 70/20* (2017.08); *B31B 70/266* (2017.08); *B31B 70/36* (2017.08); *B31B 70/874* (2017.08); *B31B 70/988* (2017.08);

(Continued)

(58) Field of Classification Search
CPC ..... B31B 2155/00; B31B 2155/003; B31B 70/14; B31B 70/142; B31B 70/148; B31B 70/16; B31B 70/20; B31B 70/36; B31B 70/874; B31B 70/98; B31B 70/986; B31B 70/988; B31B 2160/10; B31B 2160/106
USPC ..... 493/194, 195, 199, 203, 204, 227, 342, 493/373; 206/554
See application file for complete search history.

(56) References Cited

U.S. PATENT DOCUMENTS 3,196,728 A 7/1965 Snow
3,368,441 A * 2/1968 Piazze ..... B26F 1/12 83/683

(Continued)

FOREIGN PATENT DOCUMENTS

BE 1017045 12/2007
CN 201076258 6/2008

(Continued)

*Primary Examiner* — Valentin Neacsu
(74) *Attorney, Agent, or Firm* — David A. Belasco; Belasco Jacobs & Townsley, PC

(57) ABSTRACT

An apparatus for making a self-opening wide mouth bag pack includes a supply of flexible film material. An extruder forms a continuous tube. A flattener flattens the tube. A first sealer forms a bottom seal across a width of the flattened tube. A cutter cuts the flattened tube into bag blanks has a bag mouth at a predetermined distance from the bottom seal. Second and third sealers form angled seals at lower corners of the bag blank forming a flat bottomed bag. An adhesion knife penetrates the bag pack adhering adjacent bag blanks together in the bag pack. An aperture maker forms apertures for suspending the bag pack from a dispensing rack. The pack is attached to the dispensing rack and the front wall of the subsequent bag is adhered to the rear wall of a first bag, thereby causing the first bag to open when pulled from the rack.

52 Claims, 18 Drawing Sheets

Related U.S. Application Data continuation-in-part of application No. 14/542,915, filed on Nov. 17, 2014, now Pat. No. 10,105,925, which is a division of application No. 13/167,675, filed on Jun. 23, 2011, now Pat. No. 8,915,372, which is a continuation-in-part of application No. 11/502,719, filed on Aug. 11, 2006, now abandoned.

(51) Int. Cl.

| | |
|---|---|
| *B31B 160/10* | (2017.01) |
| *B31B 155/00* | (2017.01) |
| *B31B 70/16* | (2017.01) |
| *B31B 70/20* | (2017.01) |
| *B31B 70/86* | (2017.01) |
| *B31B 70/98* | (2017.01) |
| *B31B 70/26* | (2017.01) |
| *B31B 70/36* | (2017.01) |
| *B31B 160/20* | (2017.01) |
| *B31B 170/10* | (2017.01) |

(52) U.S. Cl.

CPC ..... *B31B 2155/00* (2017.08); *B31B 2155/003* (2017.08); *B31B 2160/10* (2017.08); *B31B 2160/20* (2017.08); *B31B 2170/10* (2017.08)

(56) References Cited

U.S. PATENT DOCUMENTS 3,660,959 A * 5/1972 La Fleur ..... B65D 33/065 383/7
3,739,977 A * 6/1973 Shapiro ..... B65D 31/10 493/189
3,915,077 A * 10/1975 LaFleur ..... B29C 66/0044 493/239
3,966,524 A * 6/1976 Lehmacher ..... B29C 66/80 206/390
4,220,272 A * 9/1980 Danti ..... B26F 1/10 225/2
4,261,780 A * 4/1981 Yanai ..... B29C 66/1122 156/251
4,480,750 A * 11/1984 Dancy ..... B65D 33/065 206/526
4,560,067 A * 12/1985 Reimann ..... B65D 33/001 206/526
4,636,191 A * 1/1987 Piggott ..... B26F 1/3846 493/227
4,676,378 A * 6/1987 Baxley ..... B65D 33/001 53/390
4,759,639 A 7/1988 Dematteis
4,785,938 A * 11/1988 Benoit, Jr ..... B65D 33/001 383/8
4,811,417 A * 3/1989 Prince ..... B65D 33/001 493/204
4,812,055 A * 3/1989 Prader ..... B65D 33/02 383/119
4,838,977 A 6/1989 Ebmeyer
4,877,473 A * 10/1989 Snowdon ..... B65D 33/001 156/227
4,946,431 A * 8/1990 Jensen ..... B65D 33/001 493/923
4,981,216 A * 1/1991 Wilfong, Jr. ..... B65D 33/14 493/204
4,989,732 A * 2/1991 Smith ..... B65D 33/001 383/903
4,995,860 A * 2/1991 Wilfong, Jr. ..... B65D 33/14 493/204
5,009,740 A * 4/1991 Yanai ..... B26D 5/20 493/203
5,013,290 A * 5/1991 DeMatteis ..... B65D 33/001 493/201
5,020,750 A * 6/1991 Vrooman ..... B65D 33/001 248/97
5,087,234 A * 2/1992 Prader ..... A47F 9/042 493/926
5,149,201 A * 9/1992 Benoit ..... B65D 33/065 383/8
5,183,158 A * 2/1993 Boyd ..... B65D 33/007 206/554
5,188,235 A * 2/1993 Pierce ..... B65D 33/001 383/8
5,207,328 A * 5/1993 Bose ..... B65D 33/001 383/8
5,213,145 A * 5/1993 Huang ..... A47F 13/085 141/390
5,219,220 A * 6/1993 Kucera ..... B65D 33/065 383/903
5,269,605 A * 12/1993 Nguyen ..... B65D 33/001 206/554
5,307,935 A * 5/1994 Kemanjian ..... B65D 33/001 206/554
5,333,730 A * 8/1994 Boyd ..... B65D 33/001 383/7
5,335,788 A * 8/1994 Beasley ..... B65D 33/001 206/554
5,346,310 A * 9/1994 Nguyen ..... B65D 33/001 206/554
5,363,965 A * 11/1994 Nguyen ..... B65D 33/001 206/554
5,421,803 A * 6/1995 Kemanjian ..... B65D 33/001 493/204
5,464,098 A * 11/1995 Tseng ..... B65D 33/001 383/8
5,465,846 A * 11/1995 Blyth ..... A47F 13/085 206/554
5,469,969 A * 11/1995 Huang ..... A47F 13/085 206/554
5,469,970 A * 11/1995 Li ..... B65D 33/001 206/554
5,507,713 A * 4/1996 Glod, Sr ..... B29C 66/80 493/926
5,561,967 A * 10/1996 Nguyen ..... B65B 43/14 206/554
5,562,580 A * 10/1996 Beasley ..... B65D 33/001 493/204
5,662,225 A * 9/1997 DeMatteis ..... B65B 67/04 248/97
5,667,173 A * 9/1997 Wilfong, Jr ..... B65D 33/001 248/97
5,670,013 A * 9/1997 Huang ..... B26F 3/002 156/530
5,695,064 A * 12/1997 Huang ..... B65B 43/14 206/554
5,788,121 A * 8/1998 Sasaki ..... B65D 77/065 222/105
5,816,027 A * 10/1998 Li ..... B65D 33/001 493/194
5,845,779 A * 12/1998 Wilfong, Jr ..... B65D 33/14 206/554
5,863,130 A * 1/1999 Nguyen ..... B65B 43/14 206/554
5,865,313 A * 2/1999 Huang ..... B65D 33/001 206/554
5,881,882 A * 3/1999 Fletcher ..... B65D 33/001 206/554
5,938,033 A * 8/1999 Huang ..... B26F 1/44 206/554
5,967,662 A * 10/1999 Chew ..... B65D 33/001 383/8
5,967,962 A * 10/1999 Huang ..... B26D 7/1863 493/203
5,979,655 A * 11/1999 Tseng ..... B65D 33/001 383/8
5,996,801 A * 12/1999 Tsu ..... B65D 33/001 206/554
6,105,780 A * 8/2000 Nguyen ..... B65D 33/001 383/8
6,149,007 A * 11/2000 Yeh ..... B65D 33/08 206/554

(56) References Cited

U.S. PATENT DOCUMENTS 6,171,226 B1 * 1/2001 DeMatteis ..... B29C 65/18 493/227
6,186,933 B1 * 2/2001 DeMatteis ..... B29C 66/4312 493/193
6,269,950 B1 * 8/2001 Nguyen ..... B65B 43/14 206/554
6,286,681 B1 * 9/2001 Wilfong, Jr ..... B65D 33/01 383/110
6,325,214 B1 * 12/2001 Smithson ..... B65D 33/001 206/554
6,435,350 B1 * 8/2002 Huang ..... B65B 43/14 206/554
6,446,810 B1 * 9/2002 Huang ..... B65D 33/001 206/554
6,502,371 B2 * 1/2003 DeMatteis ..... B65B 43/14 383/103
6,505,750 B1 * 1/2003 Nguyen ..... A47F 9/042 211/163
6,585,197 B1 * 7/2003 Daniels ..... A47F 9/042 248/97
6,659,644 B2 * 12/2003 Gebhardt ..... B65D 33/01 383/103
6,716,296 B2 * 4/2004 Chum ..... B65D 33/001 383/7
6,755,774 B1 * 6/2004 Nosaka ..... B31B 50/00 493/189
7,093,978 B2 * 8/2006 Tan ..... B31B 70/00 383/120
7,753,588 B2 * 7/2010 Bazbaz ..... B65D 33/065 211/85.15
8,067,072 B2 * 11/2011 Tan ..... B65D 33/001 428/34.3
8,915,372 B2 * 12/2014 Tan ..... B65D 33/007 206/554
10,105,925 B2 * 10/2018 Tan ..... B31B 70/14
2001/0029724 A1 * 10/2001 DeMatteis ..... B65B 43/14 206/554
2002/0009575 A1 * 1/2002 DeMatteis ..... B29C 66/1122 428/167
2002/0074260 A1 * 6/2002 Huang ..... B65D 33/001 493/194
2002/0108882 A1 * 8/2002 DeMatteis ..... B65D 33/001 206/554
2002/0134702 A1 * 9/2002 DeSmedt ..... B65B 43/28 53/473
2004/0074364 A1 * 4/2004 Prudhomme ..... B26F 1/04 83/687
2005/0041890 A1 * 2/2005 Tan ..... B65D 33/001 383/105
2005/0087542 A1 * 4/2005 Bazbaz ..... B65D 33/001 221/33
2005/0103679 A1 * 5/2005 Smithson ..... B65D 33/001 206/449
2005/0139508 A1 * 6/2005 Su ..... B65D 33/065 206/390
2005/0259892 A1 * 11/2005 Tan ..... B65D 33/002 383/105
2005/0276669 A1 12/2005 Pottorff
2006/0045393 A1 * 3/2006 Daniels ..... B65D 33/004 383/127
2006/0078233 A1 * 4/2006 Winiecki ..... B65D 33/105 383/104
2006/0194684 A1 * 8/2006 Tan ..... B31B 70/00 493/194
2008/0035522 A1 * 2/2008 Tan ..... B65D 33/007 206/554
2009/0268990 A1 10/2009 Wilson et al.
2009/0274396 A1 * 11/2009 Wilkerson ..... B65D 33/001 383/9
2010/0162665 A1 * 7/2010 Tan ..... B26D 7/10 83/684
2010/0167893 A1 * 7/2010 Wilkerson ..... B31B 70/00 493/227
2012/0136255 A1 5/2012 Fan
2012/0160732 A1 * 6/2012 Tan ..... B31B 70/14 493/227
2013/0062499 A1 3/2013 Kloosterboer
2014/0363105 A1 * 12/2014 Pelletier ..... C08L 23/06 524/427
2015/0072849 A1 * 3/2015 Tan ..... B31B 70/14 493/204
2019/0030850 A1 * 1/2019 Tan ..... B65D 33/007

FOREIGN PATENT DOCUMENTS

| | | |
|---|---|---|
| CN | 201321187 | 10/2009 |
| CN | 202276941 | 6/2012 |
| CN | 202341206 | 7/2012 |
| CN | 204232434 | 4/2015 |
| DE | 10116920 | 10/2002 |
| GB | 1149673 | 4/1969 |
| GB | 1594119 | 7/1981 |
| JP | 3130529 | 3/2007 |
| KR | 20040097891 | 11/2004 |
| KR | 100868796 | 11/2008 |

* cited by examiner

SELF OPENING WIDE MOUTH CARRYOUT BAG PACK, APPARATUS AND METHOD OF MAKING SAME

RELATED APPLICATIONS

This application is Divisional of U.S. application Ser. No. 16/132,370, filed Sep. 15, 2018 and currently pending, which is a Continuation-in-Part of U.S. application Ser. No. 14/542,915, filed Nov. 17, 2014 and issued as U.S. Pat. No. 10,105,925 on Oct. 23, 2018, which is a Divisional of U.S. application Ser. No. 13/167,675, filed Jun. 23, 2011, issued as U.S. Pat. No. 8,915,372 on Dec. 23, 2014, which is a Continuation-in-Part of U.S. application Ser. No. 11/502,719, filed Aug. 11, 2006, now abandoned, all of which are incorporated herein by reference in their entirety.

FIELD OF INVENTION

The invention pertains to film bags typically used for groceries, produce or other merchandise. More particularly, the invention relates to film bags for use with dispensing racks that are designed to open as bags are pulled from the dispenser.

BACKGROUND OF THE INVENTION

Film bags are commonly used in supermarkets, department stores and similar applications. These bags have advantages in that they are relatively inexpensive to produce, provide substantial carrying capacity and may include easily used handles. In order to make these bags easier to handle and easier to fill, they are usually used in combination with a dispensing rack or hook. Dispensing racks typically include a pair of horizontally oriented arms from which the bags are suspended by means of holes in upper portions of the bags. If the bags can be made to open as they are pulled from the dispensing rack or hook, they become substantially easier to use. Various techniques have been developed for causing film bags to open as they are removed from dispensing racks or hooks.

U.S. Patent Application No. 2005/0087542, issued to Bazbaz is directed to a tabless, self-opening T-shirt-styled film bag is provided having a handle, stress relief notch, and mounting tab structure for providing a wide-opening bag mouth and a bag having high weight carrying capacity. Handles have a narrow upper portion, a wide middle portion and a narrow lower portion. Handle mounting apertures are provided in the wide middle portion, which projects inwardly above the mouth of the bag. The handle mounting apertures are formed by a blade having an elongate section that is bent to form an obtuse angle.

The handle mounting aperture has a sufficient width for accommodating arms of a dispensing rack and a height about three times as great as the width. The bag has a central mounting tab extending above the mouth of the bag and between the handles. A stress relief notch having a reasonably tight radius of curvature is provided between each handle and the mounting tab. The mounting tab has a mounting aperture formed by two blades meeting at a sharp corner, the corner having essentially no radius of curvature. A severable region is provided between the corner and an outer edge of the mounting tab, which can tear as the bag is removed from a mounting hook on a dispensing rack. Multiple bags are aligned and bonded together to provide a unitary pack, where pulling one bag off a dispensing rack pulls an adjacent bag open.

U.S. Pat. No. 4,676,378 issued to Baxley et al., discloses a bag pack comprising a stack of film shopping bags that are bound together and mounted on a rack in such a manner that as one is removed from the rack, the next is opened and remains on the rack to receive material therein.

The rack that is used in this invention for the bag pack comprises a flat base with a pair of laterally spaced support arms to accommodate fully expanded bags with handles engaged with the support arms. A transverse member extends between the support arms to support a tab receiving hook element for engagement through the tab apertures. When the bag pack is produced, and either prior to or simultaneously with the forming of a cut line through the stacked bag handles, the flaps are bonded together throughout the full stack. This is done by use of a heated pin or rod extended centrally through the flaps to directly heat seal the flaps together.

U.S. Pat. No. 6,105,780, issued to Nguyen describes a bag and dispensing system wherein the thermoplastic bag to be dispensed may be retained in an open position, to allow for the loading thereof with contents for carrying, such as purchased goods or the like. The system is further configured such that the loaded bag, when dispensed, draws the next bag in the stack forward into an open loading position such that it is ready to be loaded with goods without further manipulation by the attendant. The preferred embodiment of the present invention teaches the utilization multi-edged punch applied to the handle area of the bags to hold said handles together for handling of the bag pack, and for facilitating opening of the next bag in the stack on the rack, when a loaded bag is removed.

The preferred embodiment of the present invention utilizes co-extruded film, wherein there is provided a high density film having bonded thereto a lower density film of lesser density than said high density film, such that said lower density film forms the exterior side of said co-extruded film. The co-extruded film is then corona treated at a higher energy level than that recommended for facilitating a printing surface on said film. The film is then die-cut to form bag packs, and simultaneously punched with the multi-faceted punch in the area of the handles. This punch impacts the film forming the bag walls, melding the adjacent walls together in a releasable fashion, allowing self opening of said bags.

U.S. Pat. No. 5,207,328, issued to Huang et al. is directed to a pack of self-opening bags with a front, rear, and co-joined side walls, with front and rear tabs extending from top edges of the front and rear walls. The tabs have a curved aperture slits therein, and the tabs are frangibly adhered together with contact adhesive. The slit has a main cut section, a first curved end section at one end, and a second curved end section at the opposite end. The first curved section has a curve that extends upwardly and inwardly from the main cut section. The second curved section has a substantially semi-circular curve that extends from the main cut section in a direction towards the bottom edge of the tab and has an end that is substantially perpendicular to and adjacent the main cut section. In one embodiment, the first curved section is dashed.

U.S. Patent Application No. 2002/0108882 issued to DeMatteis is directed to a tab for mounting a bag bundle on a retaining hook of the type having an upwardly bent hook is shown configured in a bundle of bags. The bundle of bags has at least a leading bag and a plurality of trailing bags. There is at least one tab attached to one bag wall of each bag. This tab is in alignment with like tabs from like bag walls. The tab includes a flanged aperture including at least one peak, with this peak protruding inwardly toward and to the aperture for contact with the upwardly bent hook whereby the tabs are bent out of alignment with the upwardly shaped hook.

U.S. Pat. No. 4,636,191 issued to Piggott discloses a bag making machine for producing bags from an elongate strip of plastic web material. The disclosure relates to various improvements in the bag making machine such as the apparatus for cutting the bag handle aperture. The apparatus includes at least one circular cutting blade having a plunger movable relative thereto within its cutting periphery. The plunger includes a web piercing member on its leading face which member positively holds the web material relative to the cutting blade and plunger.

U.S. Patent Application No. 2004/0074364, issued to Prudhomme describes a multiple variable punch assembly is configurable for punching holes and slits in a plastic film material. The assembly has frame is positioned below the plane of film with one or more transverse carriages positioned to slide on the sides of the frame. Each of the carriages has side plate members, and upper and lower rails extending across the frame in the transverse direction. The upper rail is positioned above the plane of the film and the lower rail is positioned directly below the upper rail and below the film web plane. The positions of the carriages can be adjusted along the frame in the machine direction. The punch head assemblies are adjustably mounted the carriages, with an upper plate fitted onto the upper carriage rail and a lower backing plate situated beneath it on the lower carriage rail. An alignment pin can be inserted into aligned holes for positioning the upper plate and the lower backing plate. An auxiliary carriage can be mounted on one of the main carriages, and provides a pair of auxiliary rails for mounting an additional punch head.

While other variations exist, the above-described designs for self-opening bag packs are typical of those encountered in the prior art. It is an objective of the present invention to provide for a film bag pack that is suitable for use with standardized dispensing racks and includes at least one self-opening feature. It is a further objective to provide this capability in a bag pack that includes bags that are durable, break-resistant and easily produced. It is a still further objective of the invention to provide the above-described bag packs without the need for localized compressed areas in the bag pack. Finally, it is an objective of the invention to provide bags that open with uniform force from the first bags of the pack to the last.

While some of the objectives of the present invention are disclosed in the prior art, none of the inventions found include all of the requirements identified.

SUMMARY OF THE INVENTION

The present invention addresses all of the deficiencies of prior art self-opening bag pack inventions and satisfies all of the objectives described above.

(1) A self-opening wide mouth carryout bag pack providing the desired features may be constructed using the following apparatus. A supply of flexible film material is provided. An extruder is provided. The extruder forms a continuous tube of film. A folder is provided. The folder folds in first and second side gussets. A flattener is provided. The flattener forms a continuous flattened tube. A first sealer is provided. The first sealer forms a bottom seal across a width of the flattened tube at a predetermined interval. A cutter is provided. The cutter cuts the flattened tube into bag blanks at a predetermined distance from the bottom seal. The bag blanks have front and rear walls, first and second side edges, a top edge, a bottom edge and a mouth portion.

A second sealer is provided. The second sealer forms a first angle seal. The first angle seal extends from the first side edge of the front and rear walls across the bottom seal at a point spaced outwardly from an innermost portion of the first side gusset at the bottom edges of the front and rear walls. A third sealer is provided. The third sealer forms a second angle seal. The second angle seal extends from the second side edge of the front and rear walls across the bottom seal at a point spaced outwardly from an innermost portion of the second side gusset at the bottom edges of the front and rear walls. A stacker is provided. The stacker forms the bags into a bag pack with the top edges aligned. A die cutter is provided. The die cutter cuts a bag mouth orthogonal to a length of the flattened tube and cuts a handle opening adjacent the bag mouth. The first and second angle seals create a wide mouth carryout bag having a substantially flat bottom when the bag is opened. The flat bottom has three layers of material in the region formed from the first and second angle seals. The substantially flat bottom includes two layers of bag material extending beyond the bottom seal. An aperture maker is provided. The aperture maker penetrates the bag pack and forms first and second apertures for suspending the bag pack from a dispensing rack.

An adhesion knife is provided. The knife has a single non-linear elongated cutting edge and provides a single non-linear elongated knife cut. The single non-linear knife cut extends completely through front and rear walls of each of the bag blanks in the bag pack. The knife cut has first and second ends and first and second elongated non-linear edges. The knife cut adheres adjacent bag blanks together in the bag pack along both of the first and second elongated non-linear edges and provides self-opening features.

The bag pack is suspended from the dispensing rack and a first bag is pulled outwardly from the bag pack, the first and second edges of the knife cut in the front wall of a subsequent bag will be adhered to the first and second edges of the knife cut in the rear wall of the first bag, thereby causing the first bag to open.

(2) In a variant of the invention, the first and second edges of the knife cut are spaced apart by a distance ranging from 0.02 inches to 0.3 inches.

(3) In yet another variant, the knife cut is S-shaped.

(4) In a further variant, the knife cut is Z-shaped.

(5) In still a further variant, the knife cut is in the form of a straight line, said straight line having at least one curved section at either of first and second ends of the straight line.

(6) In yet further variant, a corona treater is provided. The corona treater treats at least one of the front and rear walls. The corona treatment provides additional adhesion for printing ink on the bag walls.

(7) In another variant, a dual corona treater is provided. The dual corona treater treats the front wall and the rear wall, thereby providing additional adhesion between adjacent bags in the bag pack and enhancing self-opening capability for the bag pack.

(8) In still another variant, the die cutter forms the bag mouth in a wave form.

(9) In yet another variant, the die cutter forms the bag mouth with a central mounting tab. The central mounting tab has at least one mounting opening. The opening is sized and shaped to fit slidably over a central dispenser rack mounting hook, the central mounting tab is frangibly attached to the top edges of the front and rear walls above the handle opening.

(10) In another variant of the invention, the central mounting tab further includes an alignment feature. The alignment feature fastens the central mounting tab to a subsequent central mounting tab in the bag pack, thereby permitting easy mounting of the central mounting tabs to the dispensing rack.

(11) In still another variant, the alignment feature is selected from the group comprising: proprietary bag material formulations, hot pinning, cold staking, glue spotting, knife cutting, adhesive inks and corona treatment with pressure.

(12) In a further variant, the aperture maker forms apertures including a first dispenser arm mounting aperture and a second dispenser arm mounting aperture. The first aperture penetrates the front and rear walls and the first side gusset adjacent the first side edge and the top edges of the front and rear walls. The second aperture penetrates the front and rear walls and the second side gusset adjacent the second side edge and the top edges of the front and rear walls.

(13) In still a further variant, the die cutter forms the bag mouth with a central, frangible mounting opening. The central, frangible mounting opening is centrally located in the front and rear walls adjacent the top edges of the front and rear walls and is adapted to break apart with sufficient pressure from a force of removing the wide mouth carryout bag from the dispensing rack, the central frangible mounting opening remaining with the bag when dispensed.

(14) In yet a further variant, at least one additional self-opening feature is provided, the at least one additional self-opening feature is selected from the group comprising: proprietary bag material formulations, hot pinning, cold staking, glue spotting, adhesive inks and corona treatment with pressure.

(15) In another variant of the invention, the proprietary bag material formulations comprise 0.5 wt. % slip and antiblock compound.

(16) In still another variant, the proprietary bag material formulations comprise 1-3 wt. % calcium carbonate.

(17) In yet another variant, the proprietary bag material formulations comprise 10-20 wt. % recycled material, the recycled material comprising about 40-49 wt. % high density, high molecular weight polyethylene, 12-20 wt. % high density, medium molecular weight polyethylene, 20-30 wt. % linear low density polyethylene, 0-8 wt. % color concentrate.

(18) In a further variant, the proprietary bag material formulations wherein 10-15 wt. % of the linear low density polyethylene has a density ranging from 0.923-0.924 gm/cc.

(19) In still a further variant, the proprietary bag material formulations wherein 10-15 wt. % of the linear low density polyethylene has a melt index ranging from 0.25-0.30 gm/10 minutes.

(20) In yet a further variant, the proprietary bag material formulations wherein the high density, medium molecular weight polyethylene has a density ranging from 0.937-0.947 gm/cc.

(21) In another variant of the invention, the proprietary bag material formulations wherein the high density, medium molecular weight polyethylene has a melt index ranging from 0.10-0.30 gm/10 minutes.

(22) In still another variant, the at least one additional self-opening feature is located adjacent the top edges of the front and rear bag walls.

(23) In yet another variant, the at least one additional self-opening feature is located below the first and second apertures for suspending the bag pack from the dispensing rack.

(24) In a further variant, the handle opening is of the form selected from the group comprising round, oval, racetrack, kidney shaped and elongated round.

(25) In still a further variant, the dispensing rack included a base. The base is sized to accommodate a fully open wide mouth carryout bag. A central dispenser rack mounting hook is provided. The central mounting hook is attached to a central support that extends upwardly from the base and is adapted to position a pack of wide mouth carryout bags above the base using the central mounting tab. First and second side mounting arms are provided. The first and second side mounting arms are attached to the central support. The first and second side mounting arms are adapted to engage the first and second dispenser arm mounting apertures, position a pack of wide mouth carryout bags above the base and to maintain the bags in an open position for loading.

(26) In a final variant of the invention, the dispensing rack comprises a base. The base is sized to accommodate a fully open wide mouth carryout bag. A central dispenser rack mounting hook is provided. The central mounting hook is attached to a central support extending upwardly from the base and adapted to position a pack of wide mouth carryout bags above the base using the central, frangible mounting opening. First and second side mounting arms are provided. The first and second side mounting arms are attached to the central support. The first and second side mounting arms are adapted to engage the first and second dispenser arm mounting apertures, position a pack of wide mouth carryout bags above the base and to maintain the bags in an open position for loading.

The present invention is a significant inventive step over other self-opening bag packs. Rather than relying on the melding of bag surfaces together resulting from a blunt-tipped punch applied to the top of a corona-treated bag pack (Nguyen, U.S. Pat. No. 5,363,965), the present invention utilizes a uniform knife cut that passes entirely through the pack. In the Nguyen design, the first few bags in the pack will adhere together with a certain force. As bags are removed from the pack, the adherence of one bag wall to the next will be diminished in proportion to the depth of each bag in the pack. The further the bag is from the top of the pack, the less will be the adherence of each bag to the one below it in the pack. The bags of the present invention are adhered together using an elongated cut through the bag walls of a corona treated bag. In a given bag pack, the cut extends from the first bag in the pack through the last. As it is the cut edges of the bag walls that are adhered together, and as the cuts through each bag in the pack are uniform, the force to separate the first two bags in the pack will be substantially the same as the force to separate the last two bags in the pack.

An appreciation of the other aims and objectives of the present invention and an understanding of it may be achieved by referring to the accompanying drawings and the detailed description of a preferred embodiment.

DESCRIPTION OF THE PREFERRED EMBODIMENT

The present invention addresses all of the deficiencies of prior art self-opening bag pack inventions and satisfies all of the objectives described above.

Figure 1:
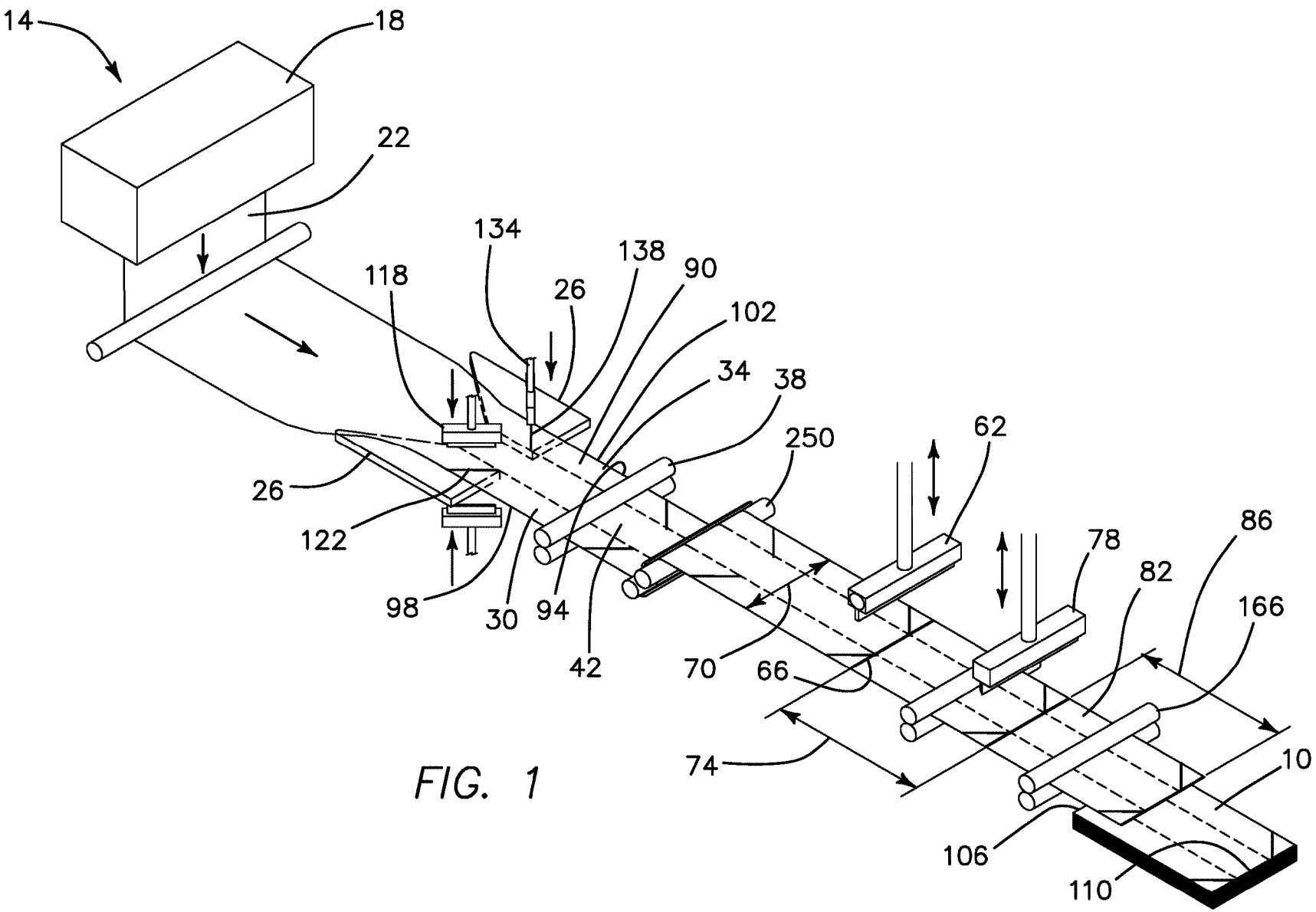
FIG. 1 is a perspective view of an apparatus for producing bag blanks for a wide mouth carryout self-opening bag.
Figure 2:
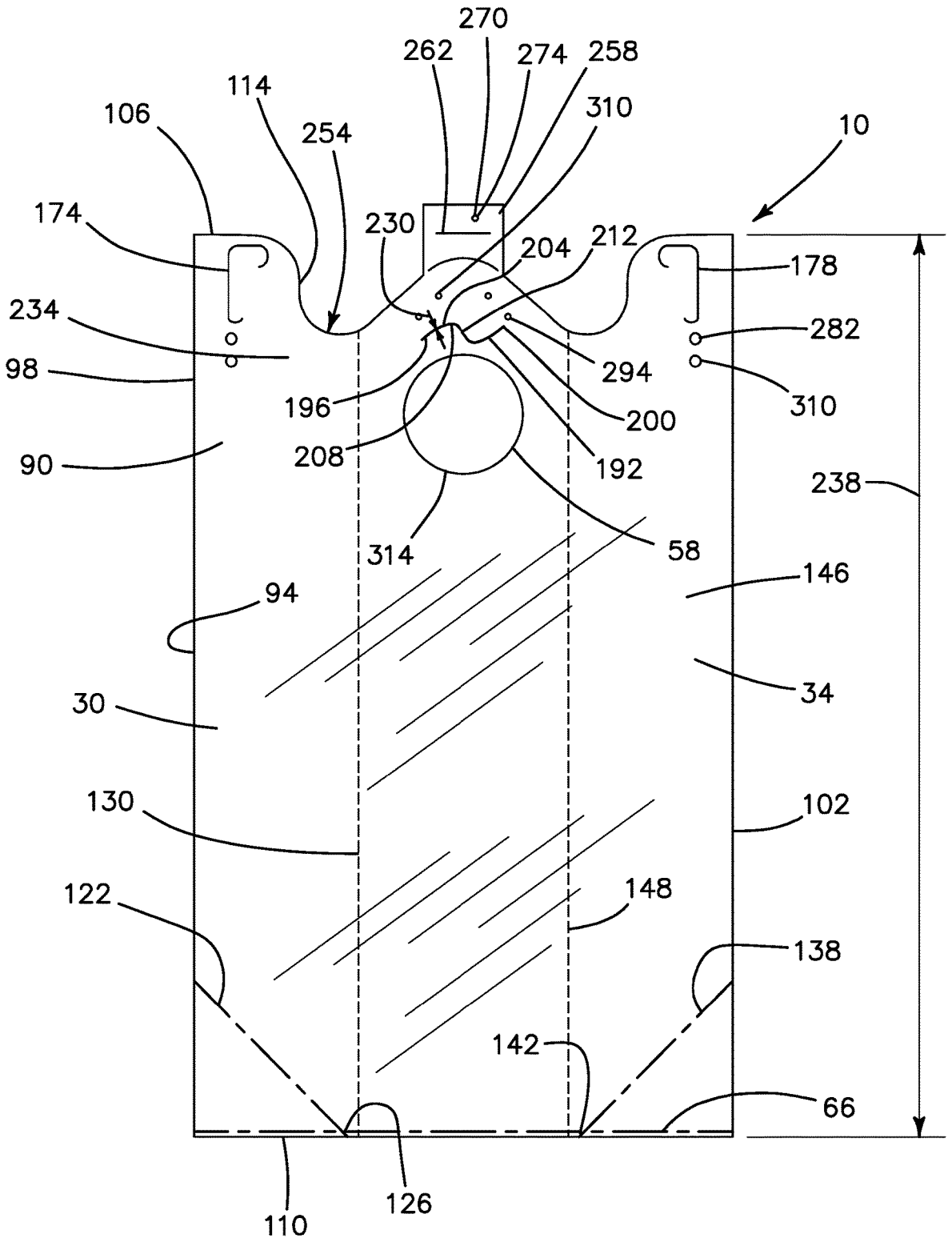
FIG. 2 is a plan view of the wide mouth carryout bag illustrating the angle seals and knife cut self-opening feature.
Figure 3:
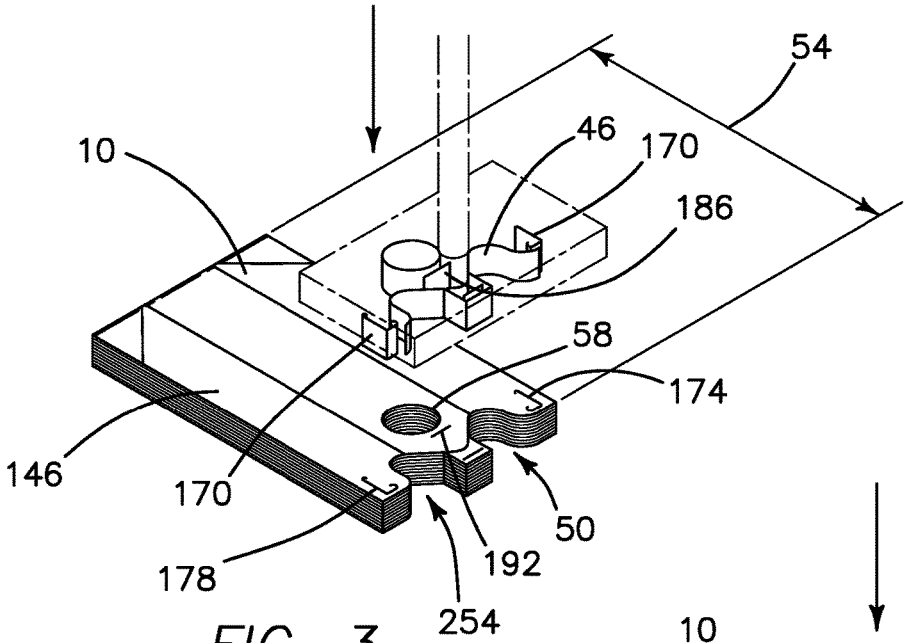
FIG. 3 is a perspective view of an apparatus for producing a wide mouth carryout bag pack illustrating a straight knife cut providing the self-opening feature.

(1) A self-opening wide mouth carryout bag pack 10 providing the desired features may be constructed using the described apparatus. As illustrated in FIGS. 1-33, a supply of flexible film material 14 is provided. An extruder 18 is provided. The extruder 18 forms a continuous tube of film 22. A folder 26 is provided. The folder 26 folds in first 30 and second 34 side gussets. A flattener 38 is provided. The flattener 38 forms a continuous flattened tube 42. A first sealer 62 is provided. The first sealer 62 forms a bottom seal 66 across a width 70 of the flattened tube 42 at a predetermined interval 74. A cutter 78 is provided. The cutter 78 cuts the flattened tube 42 into bag blanks 82 at a predetermined distance 86 from the bottom seal 66. The bag blanks 82 have front 90 and rear 94 walls, first 98 and second 102 side edges, a top edge 106, a bottom edge 110 and a mouth portion 114, as illustrated in FIGS. 1, 2 and 12.

A second sealer 118 is provided. The second sealer 118 forms a first angle seal 122. The first angle seal 122 extends from the first side edge 98 of the front 90 and rear 94 walls across the bottom seal 66 at a point 126 spaced outwardly from an innermost portion 130 of the first side gusset 30 at the bottom edges 110 of the front 90 and rear 94 walls. A third sealer 134 is provided. The third sealer 134 forms a second angle seal 138. The second angle seal 138 extends from the second side edge 102 of the front 90 and rear 94 walls across the bottom seal 66 at a point 142 spaced outwardly from an innermost portion 148 of the second side gusset 34 at the bottom edges 110 of the front 90 and rear 94 walls. A stacker 166 is provided. The stacker 166 forms the bag blanks 82 into a bag pack 10 with the top edges 106 aligned. As illustrated in FIGS. 3-7 and 14-17, a die cutter 46 is provided. The die cutter 46 cuts a bag mouth 50 orthogonal to a length 54 of the bag blank 82 and cuts a handle opening 58 adjacent the bag mouth 50. As illustrated in FIGS. 21-24, the first 122 and second 138 angle seals create a wide mouth carryout bag 146 having a substantially flat bottom 150 when the bag 146 is opened. The flat bottom 150 has three layers of material 154 in the region 158 formed from the first 122 and second 138 angle seals. The substantially flat bottom 150 includes two layers of bag material 162 extending beyond the bottom seal 66. As illustrated in FIGS. 3-7 and 14-17, an aperture maker 170 is provided. The aperture maker 170 penetrates the bag pack 10 and forms first 174 and second 178 apertures for suspending the bag pack 10 from a dispensing rack 182.

An adhesion knife 186 is provided. The knife 186 has a single non-linear elongated cutting edge 188 and provides a single non-linear elongated knife cut 192. The single non-linear knife cut 192 extends completely through front 90 and rear 92 walls of each of the bag blanks 82 in the bag pack 10. The knife cut 192 has first 196 and second 200 ends and first 204 and second 208 elongated non-linear edges. The knife cut 192 adheres adjacent bag blanks 82 together in the bag pack 10 along both of the first 204 and second 208 elongated non-linear edges and provides self-opening features 212.

Figure 9:
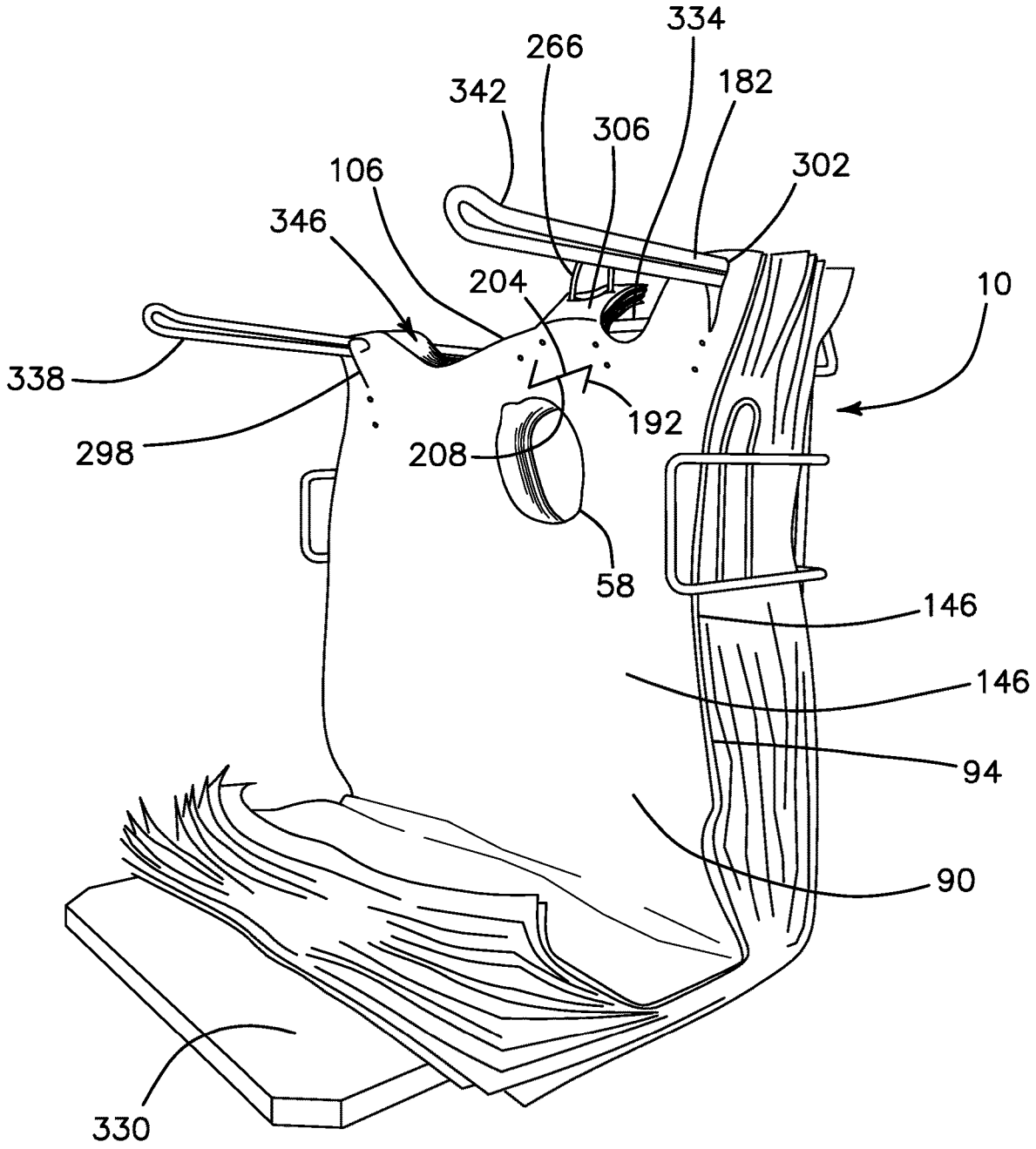
FIG. 9 is a perspective view of the FIG. 2 embodiment located upon a dispensing rack and illustrating the self-opening feature implemented through the knife cut penetrating the front and rear walls of the bag.
Figure 10:
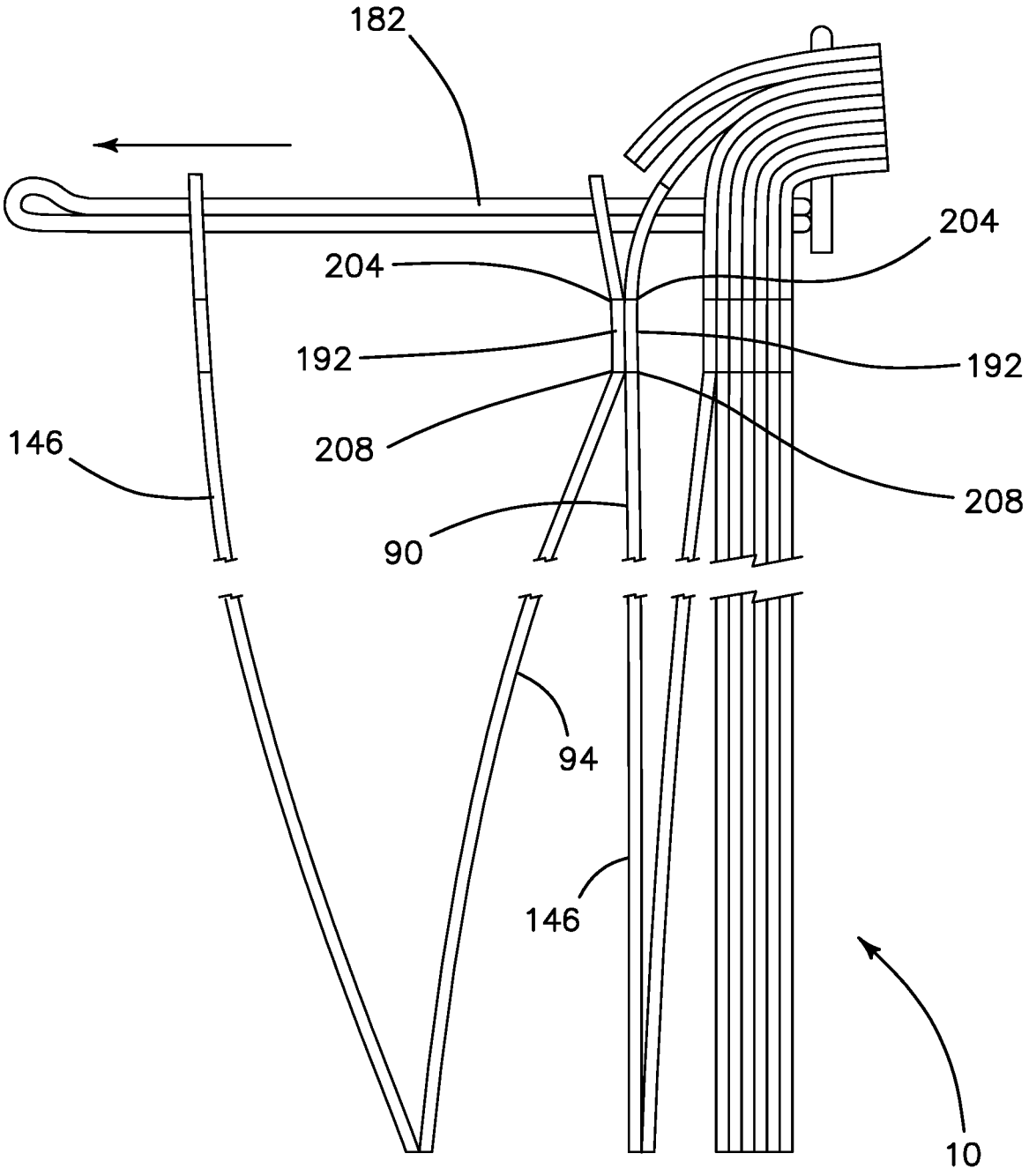
FIG. 10 is a side cross-sectional view of the FIG. 2 embodiment located upon a dispensing rack and illustrating the attachment of a first bag to a subsequent bag at the knife cuts penetrating the front and rear walls of the bag.
Figure 11:
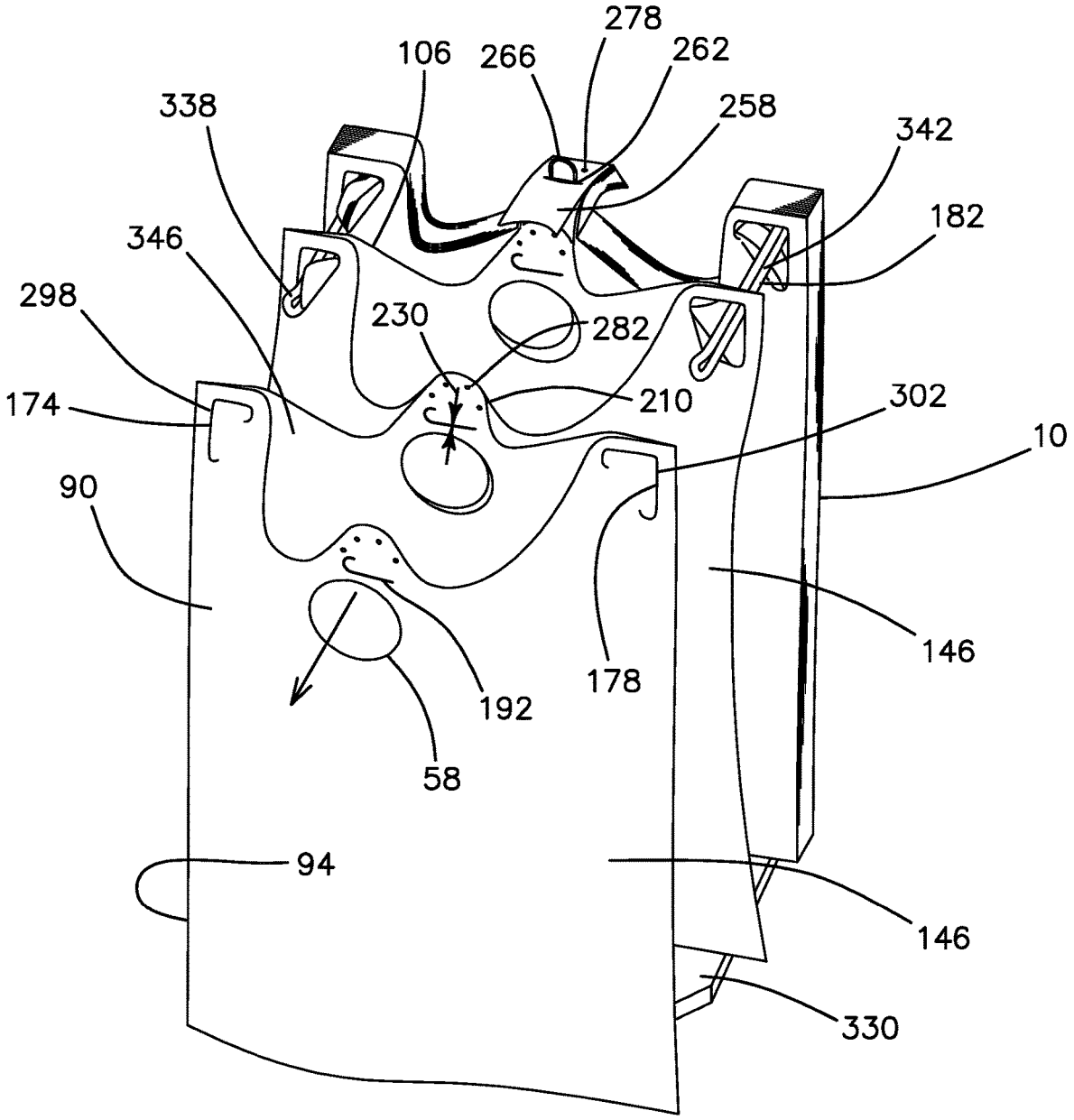
FIG. 11 is a perspective view of the FIG. 2 embodiment located upon a dispensing rack and illustrating the dispensing of the bags from the rack while the bags are opened as they leave the rack.
Figure 12:
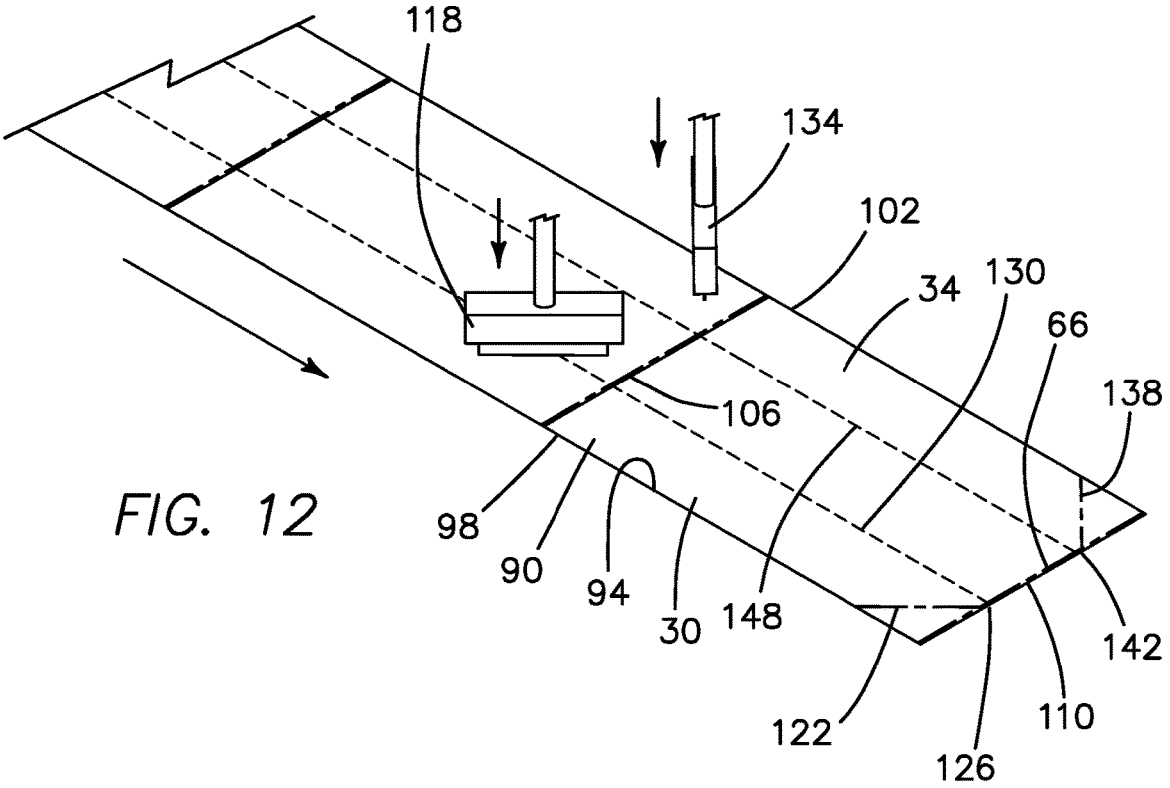
FIG. 12 is an enlarged, perspective view of the formation of the angle seals on the bag blank as illustrated in FIG. 1.

As illustrated in FIGS. 9-11, the bag pack 10 is suspended from the dispensing rack 182 and a first bag 146 is pulled outwardly from the bag pack 10, the first 204 and second 208 edges of the knife cut 192 in the front wall 90 of a subsequent bag 146 will be adhered to the first 204 and second 208 edges of the knife cut 192 in the rear wall 94 of the first bag 146, thereby causing the first bag 146 to open.

(2) In a variant of the invention, as illustrated in FIG. 11, the first 204 and second 208 edges of the knife cut 192 are spaced apart by a distance 230 ranging from 0.02 inches to 0.3 inches.

Figure 5:
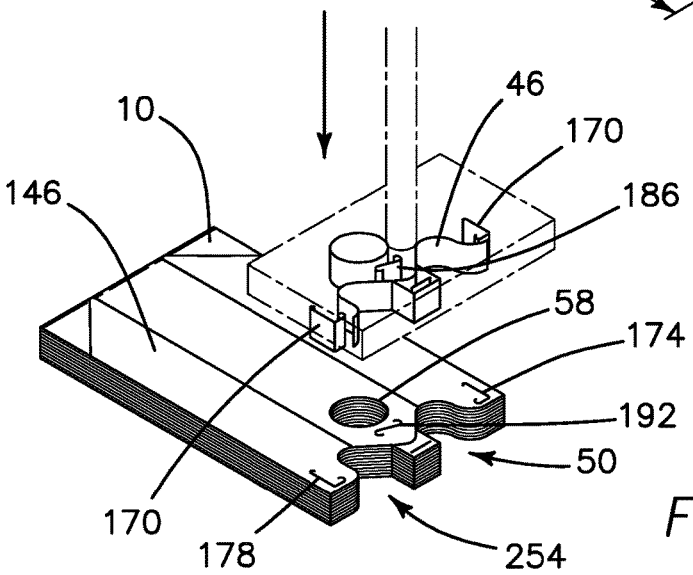
FIG. 5 is a perspective view of an apparatus for producing a wide mouth carryout bag pack illustrating an S-shaped knife cut providing the self-opening feature.
Figure 18:
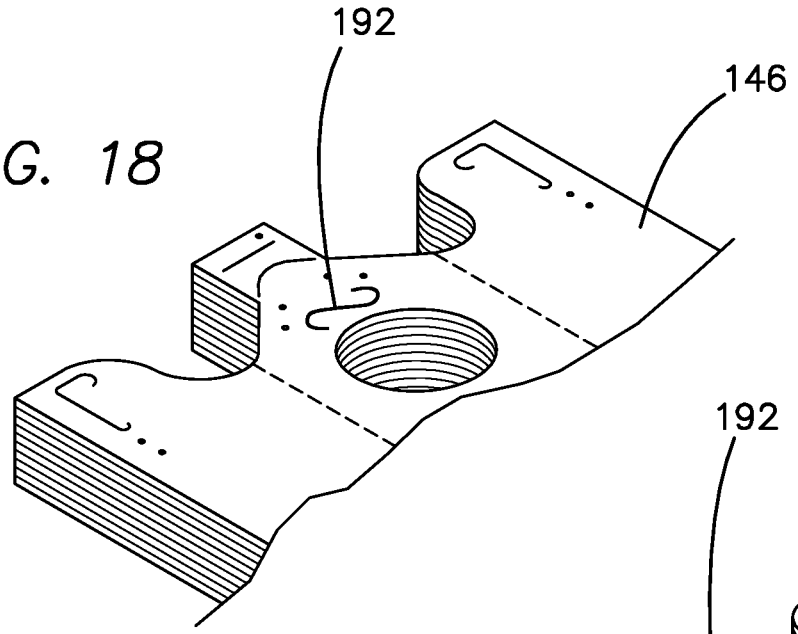
FIG. 18 is an enlarged, perspective view of the bag pack of FIG. 5.

(3) In yet another variant, as illustrated in FIGS. 5 and 18, the knife cut 192 is S-shaped.

Figure 4:
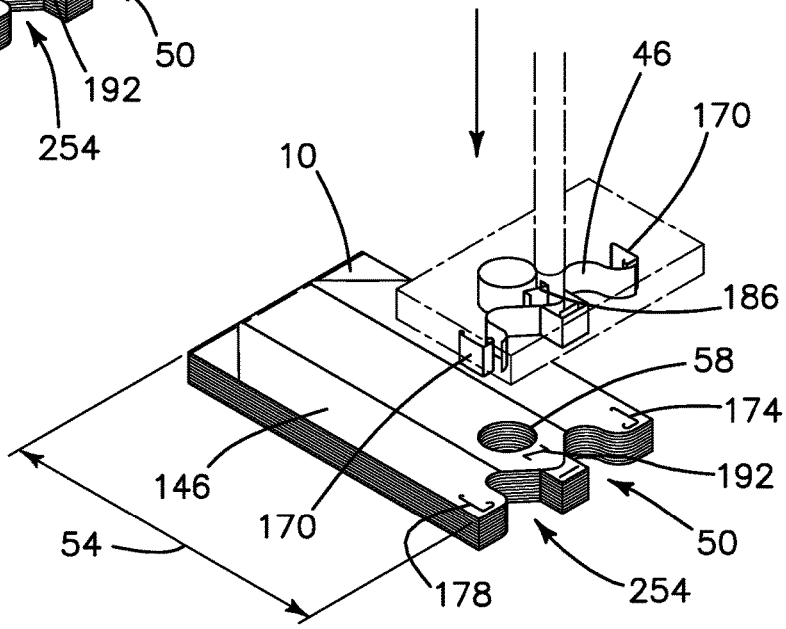
FIG. 4 is a perspective view of an apparatus for producing a wide mouth carryout bag pack illustrating a Z-shaped cut providing the self-opening feature.
Figure 19:
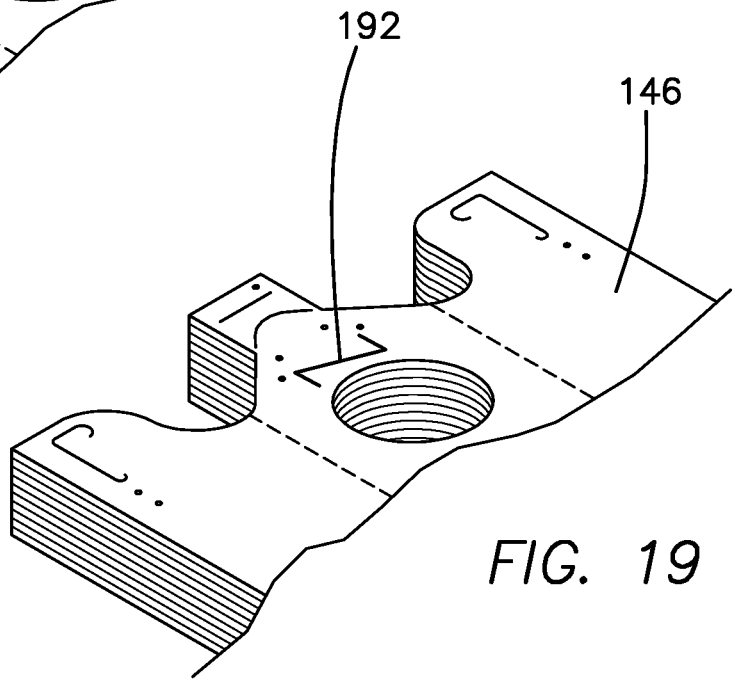
FIG. 19 is an enlarged, perspective view of the bag pack of FIG. 4.

(4) In a further variant, as illustrated in FIGS. 4 and 19, the knife cut 192 is Z-shaped.

Figure 6:
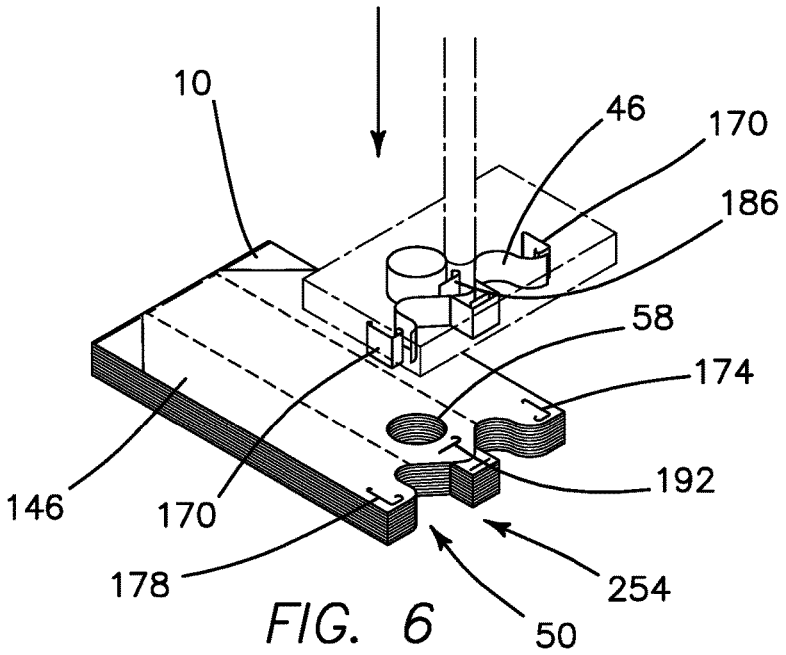
FIG. 6 is a perspective view of an apparatus for producing a wide mouth carryout bag pack illustrating a narrow, straight knife cut with curved end providing the self-opening feature.
Figure 7:
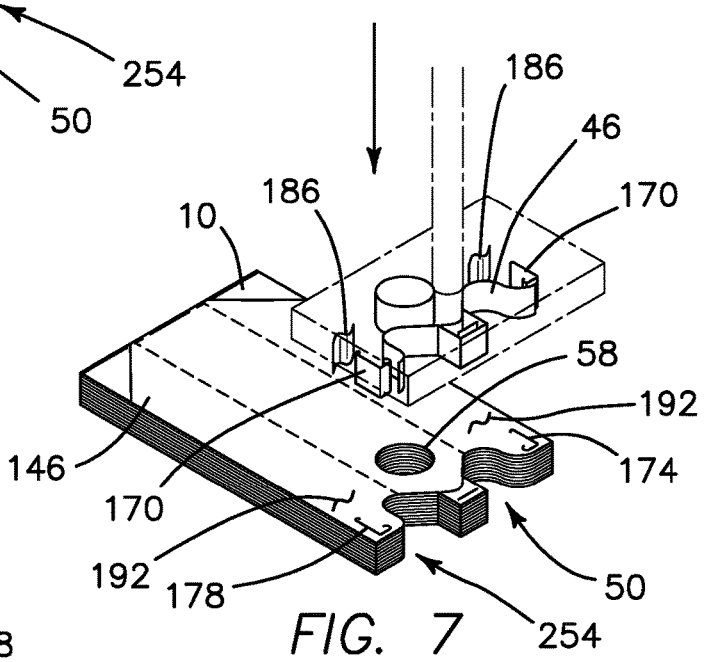
FIG. 7 is a perspective view of an apparatus for producing a wide mouth carryout bag pack illustrating a pair of straight knife cuts providing the self-opening features.
Figure 20:
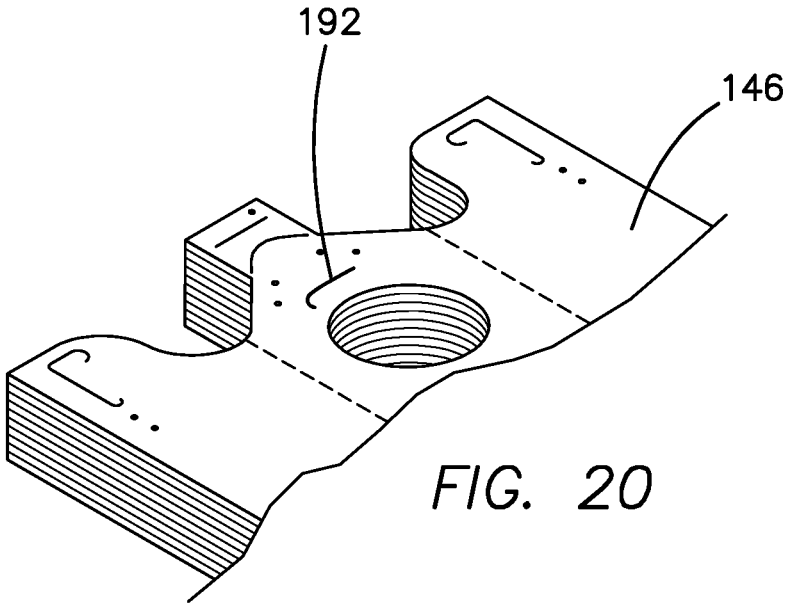
FIG. 20 is an enlarged, perspective view of the bag pack of FIG. 6.
Figure 21:
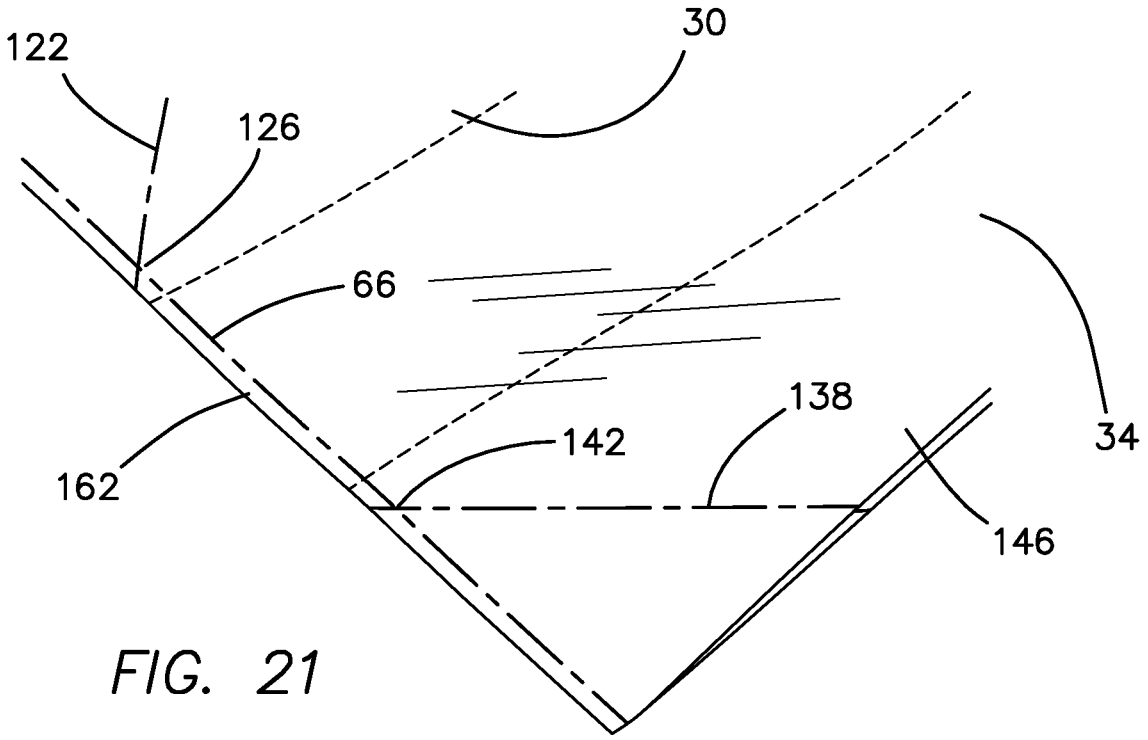
FIG. 21 is an enlarged, perspective view of the lower end of the wide mouth carryout bag illustrating the angle seals, bottom seam and material below the bottom seam.
Figure 22:
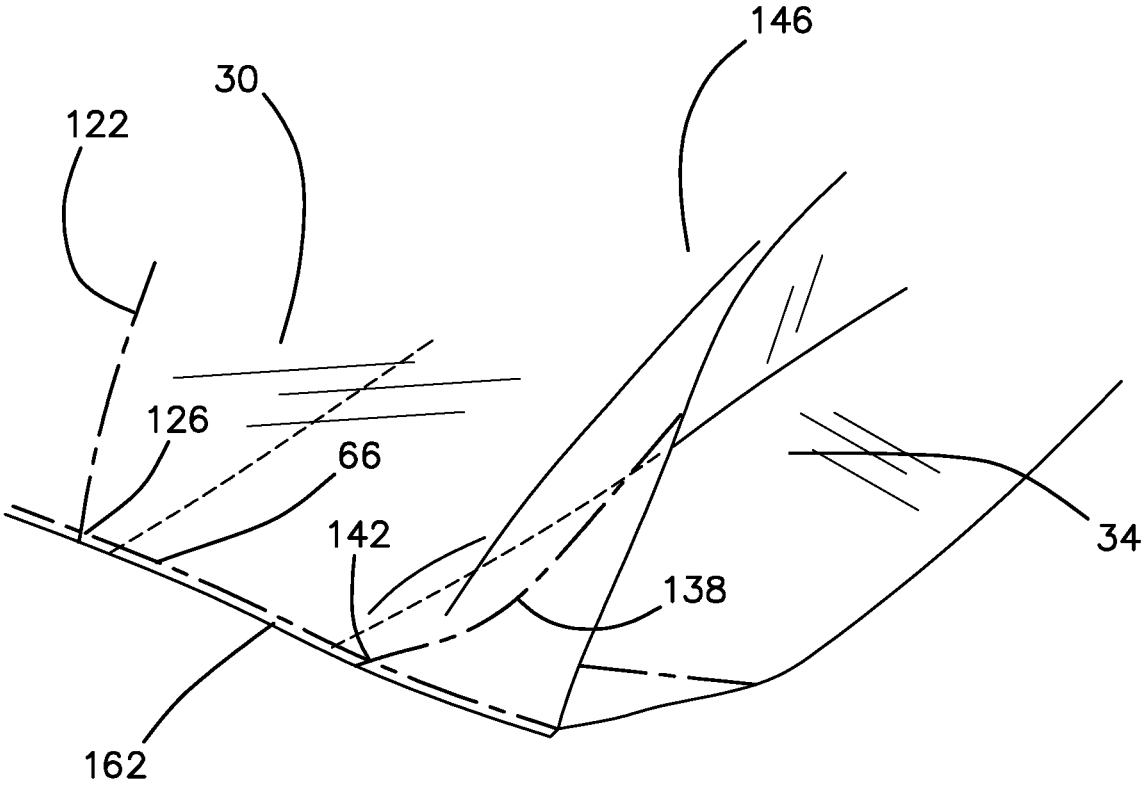
FIG. 22 is an enlarged, perspective view of the lower end of the wide mouth carryout bag illustrating the opening of one side gusset and the formation of a flat bag bottom by the angle seal.
Figure 23:
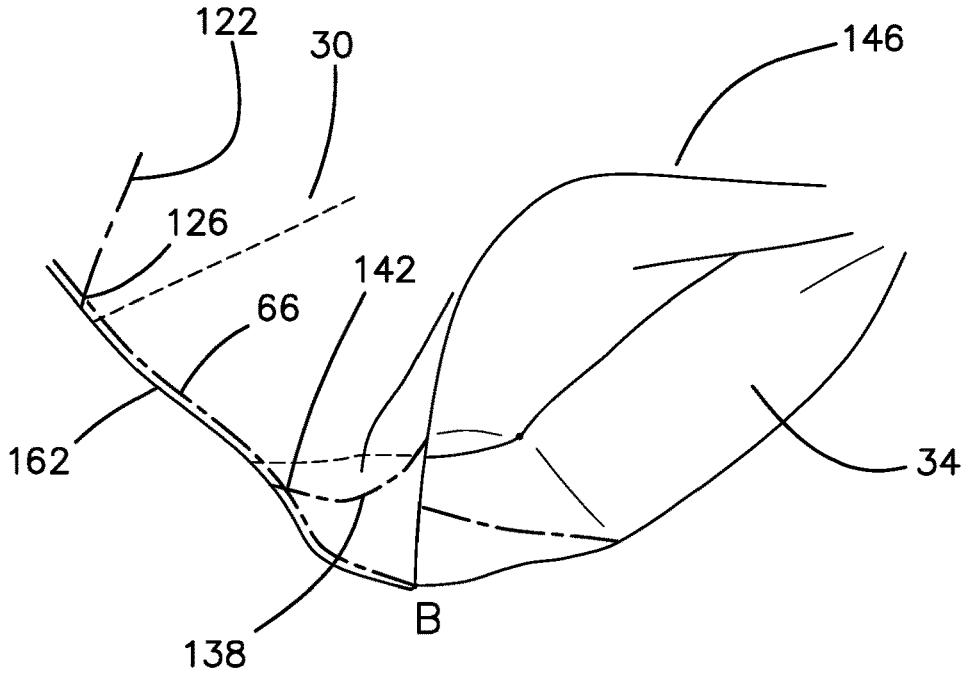
FIG. 23 is an enlarged, perspective view of the lower end of the wide mouth carryout bag illustrating the further opening of one side gusset and the formation of a flat bag bottom by the angle seal.
Figure 24:
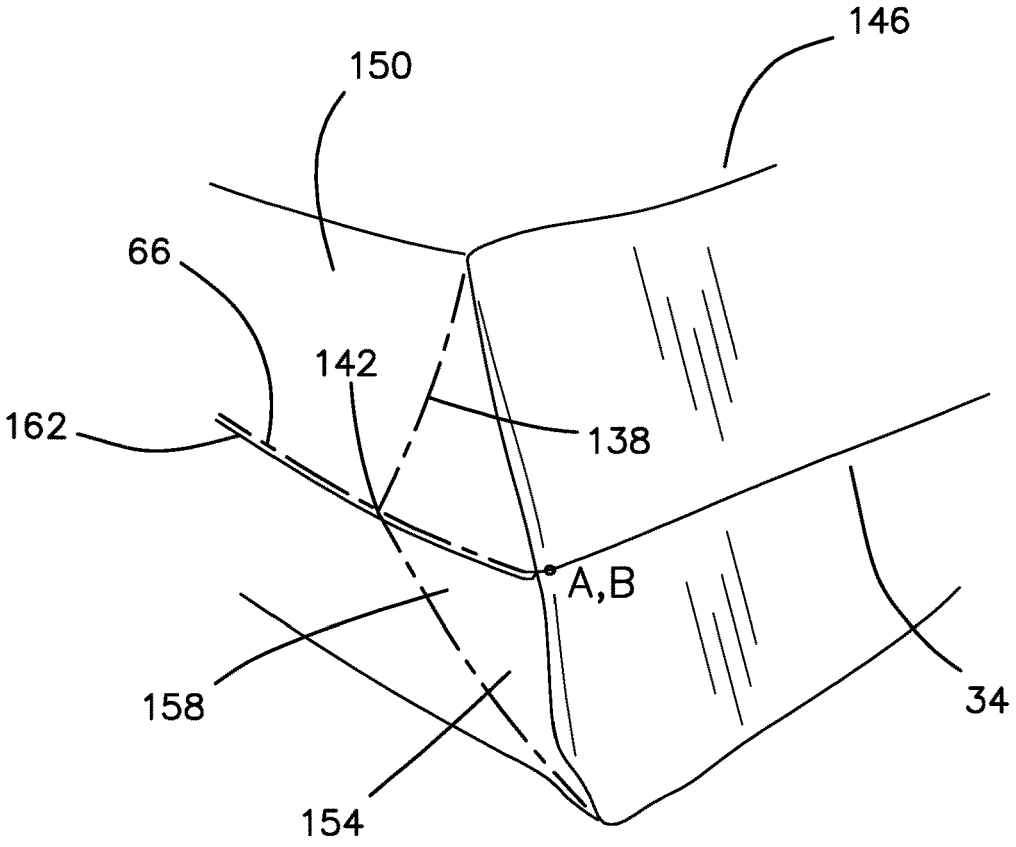
FIG. 24 is an enlarged, perspective view of the lower end of the wide mouth carryout bag illustrating one side gusset in the fully open position and the resulting flat bag bottom formed by the angle seal.

(5) In still a further variant, as illustrated in FIGS. 6 and 20, the knife cut 192 is in the form of a straight line, said straight line having at least one curved section at either of first and second ends of the straight line.

Figure 13:
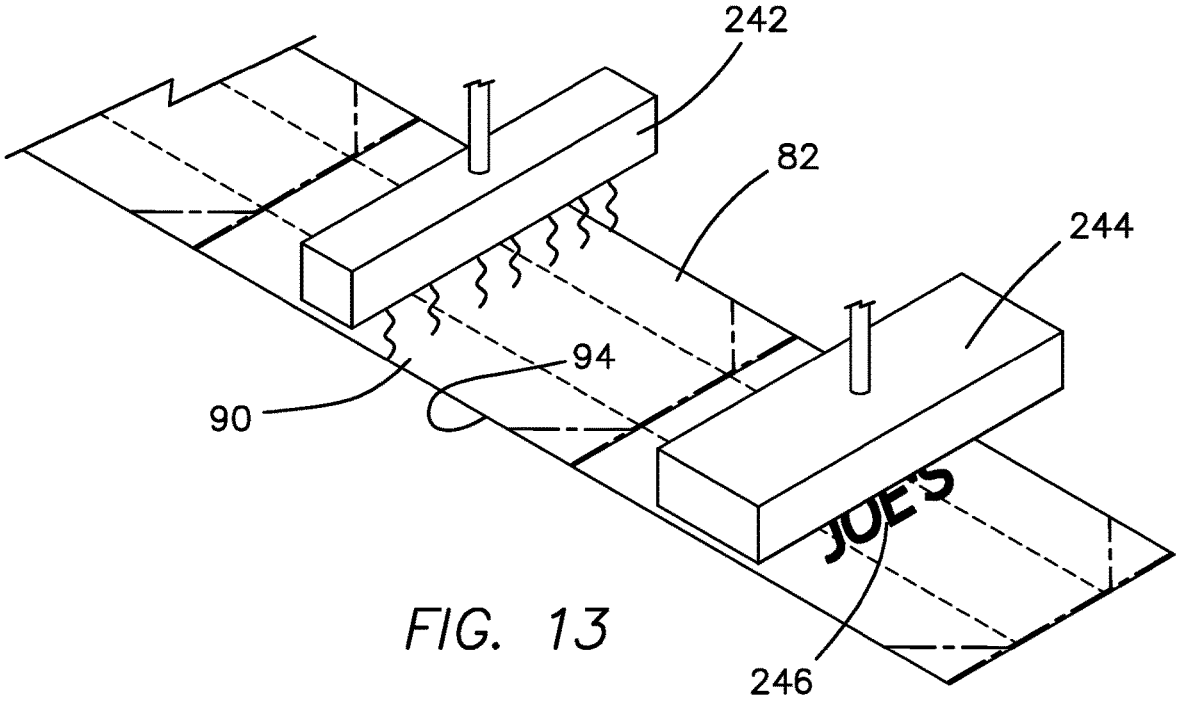
FIG. 13 is an enlarged, perspective view of an apparatus for the corona treatment of at least one surface of a bag blank.
Figure 14:
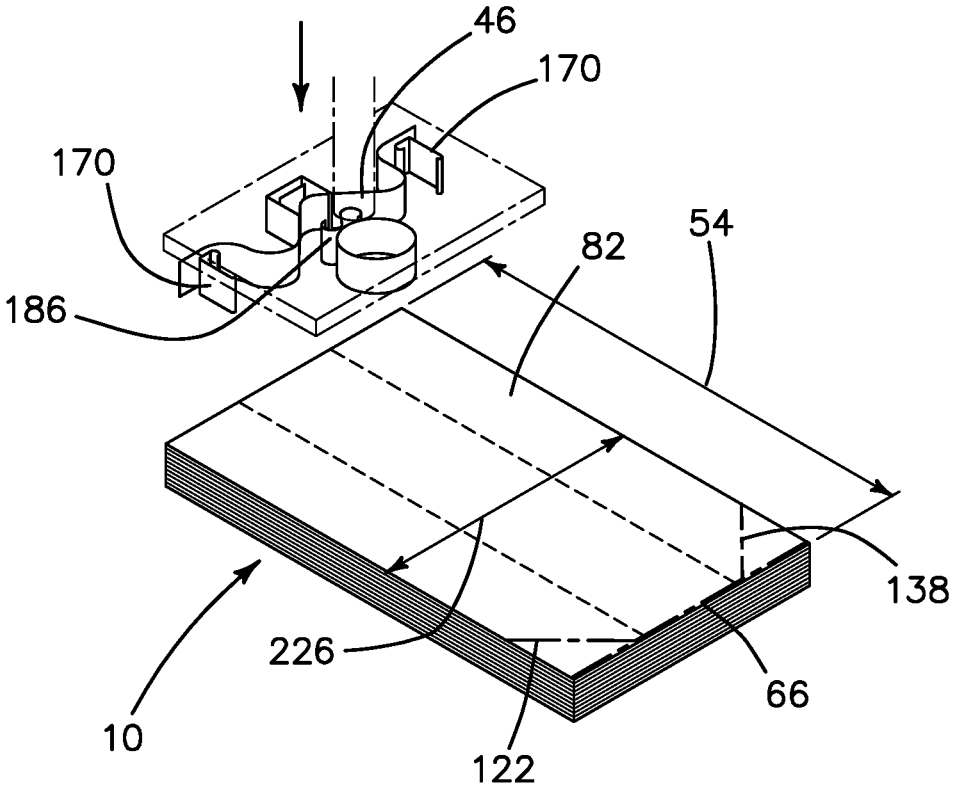
FIG. 14 is an enlarged, perspective view of the apparatus of FIG. 3.
Figure 15:
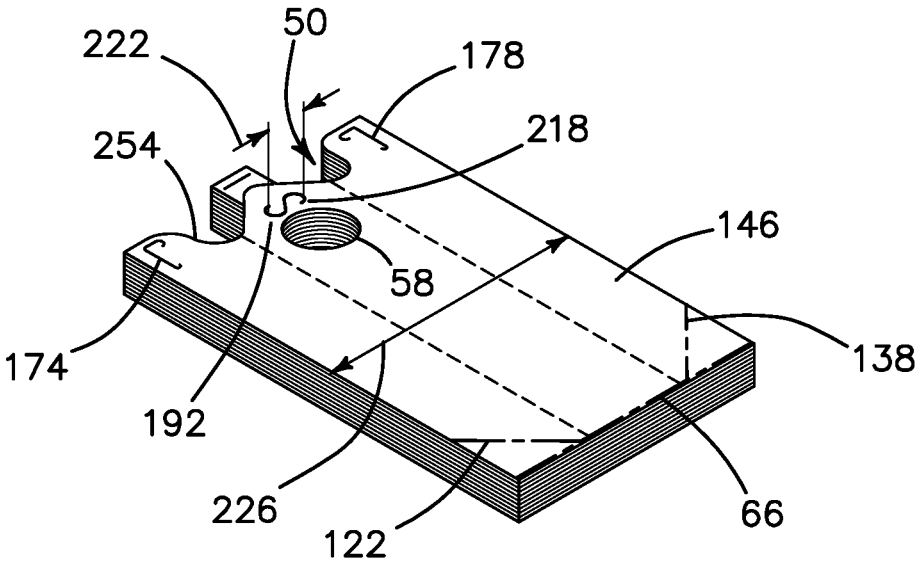
FIG. 15 is an enlarged, perspective view of the bag pack of FIG. 3.
Figure 16:
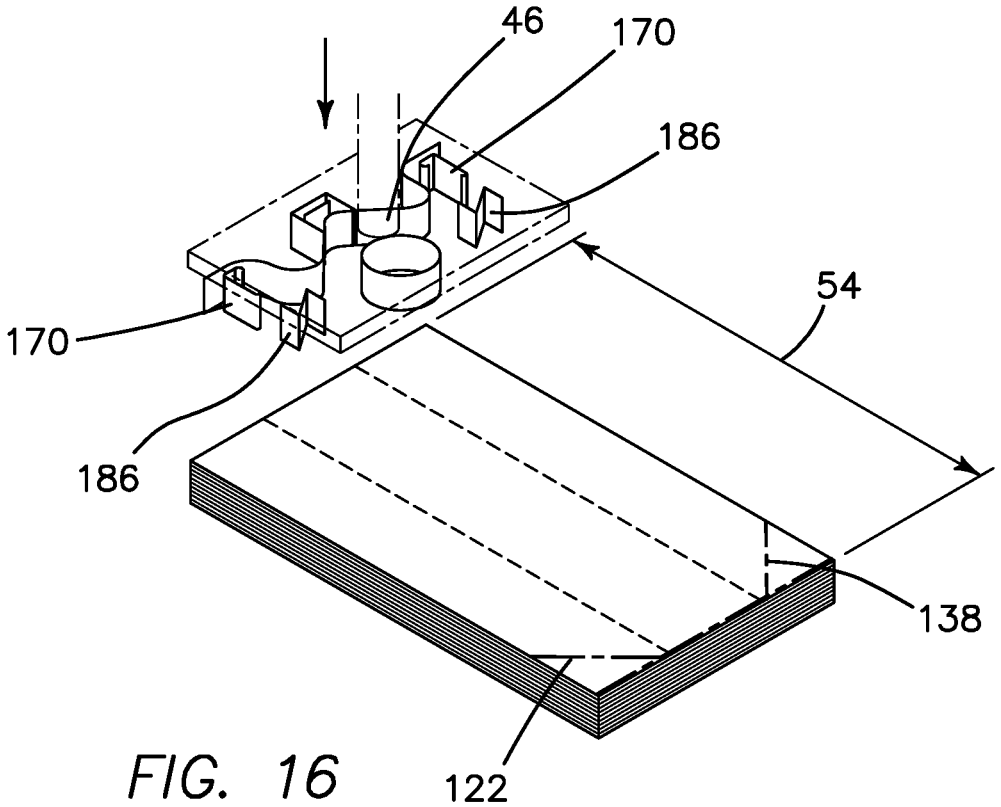
FIG. 16 is an enlarged, perspective view of the apparatus of FIG. 7.
Figure 17:
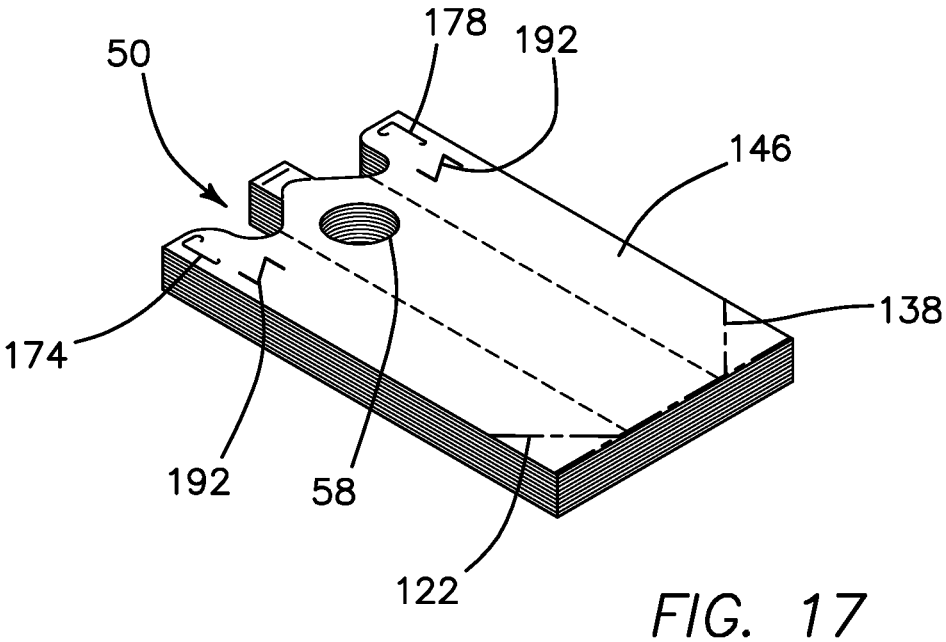
FIG. 17 is an enlarged, perspective view of the bag pack of FIG. 7.

(6) In yet further variant, as illustrated in FIG. 13, a corona treater 242 is provided. The corona treater 242 treats at least one of the front 90 and rear 94 walls. The corona treatment provides additional adhesion for printing ink 246 (add) on the bag walls 90, 94 with a print head 244.

Figure 25:
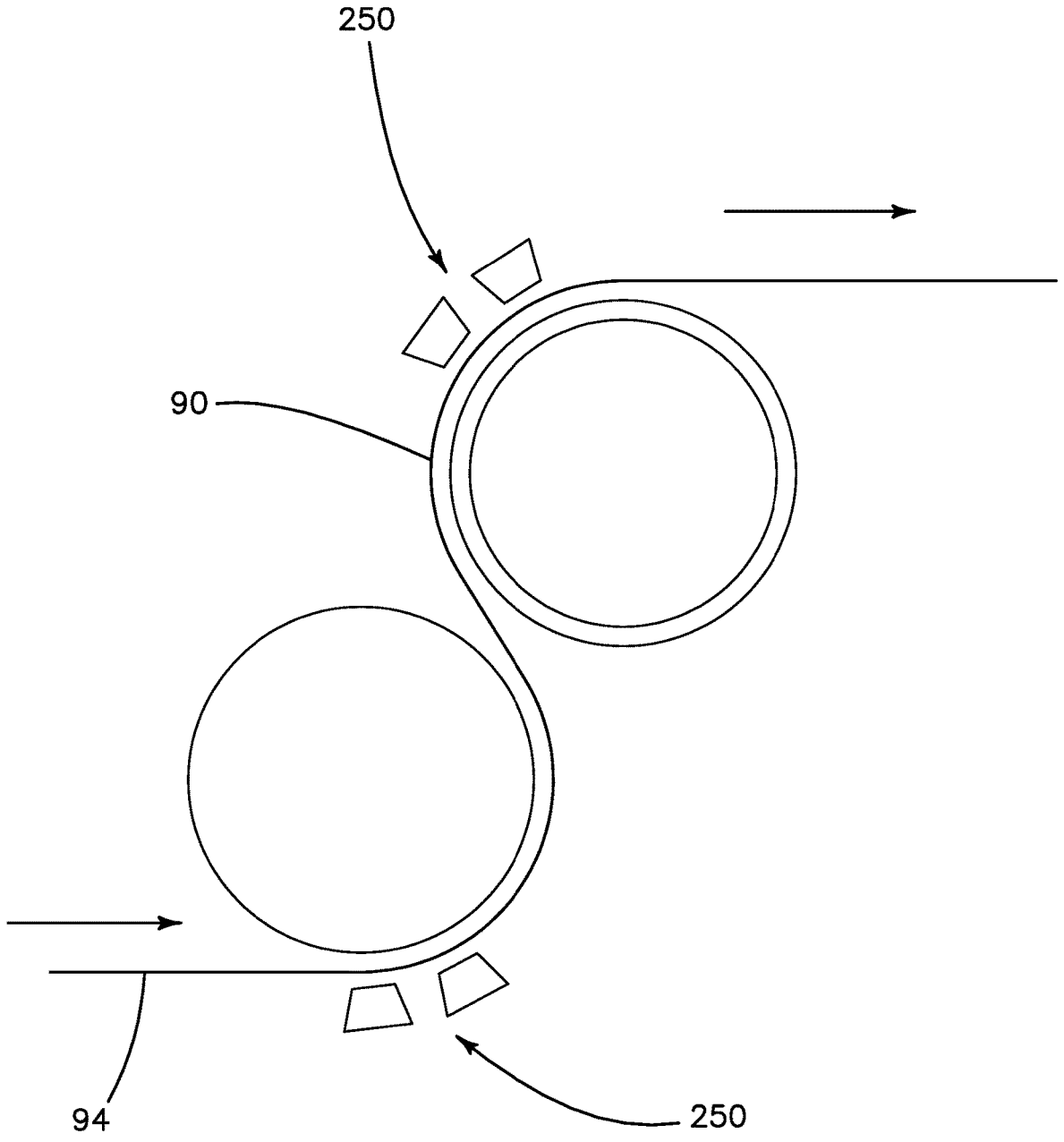
FIG. 25 is a side elevational view of an apparatus for dual corona treatment of both surfaces of a flattened film tube for formation of the wide mouth carryout bag.

(7) In another variant, as illustrated in FIGS. 1 and 25, a dual corona treater 250 is provided. The dual corona treater 250 treats the front wall 90 and the rear wall 94, thereby providing additional adhesion between adjacent bags 146 in the bag pack 10 and enhancing self-opening capability for the bag pack 10.

(8) In still another variant, as illustrated in FIGS. 2-8, the die cutter 46 forms the bag mouth 50 in a wave form 254.

(9) In yet another variant, as illustrated in FIG. 11, the die cutter 46 forms the bag mouth 50 with a central mounting tab 258. The central mounting tab 258 has at least one mounting opening 262. The opening 262 is sized and shaped to fit slidably over a central dispenser rack mounting hook 266, the central mounting tab 258 is frangibly attached to the top edges 106 of the front 90 and rear 94 walls above the handle opening 58.

(10) In another variant of the invention, as illustrated in FIG. 2, the central mounting tab 258 further includes an alignment feature 270. The alignment feature 270 fastens the central mounting tab 258 to a subsequent central mounting tab 258 in the bag pack 10, thereby permitting easy mounting of the central mounting tabs 258 to the dispensing rack 182.

Figure 8:
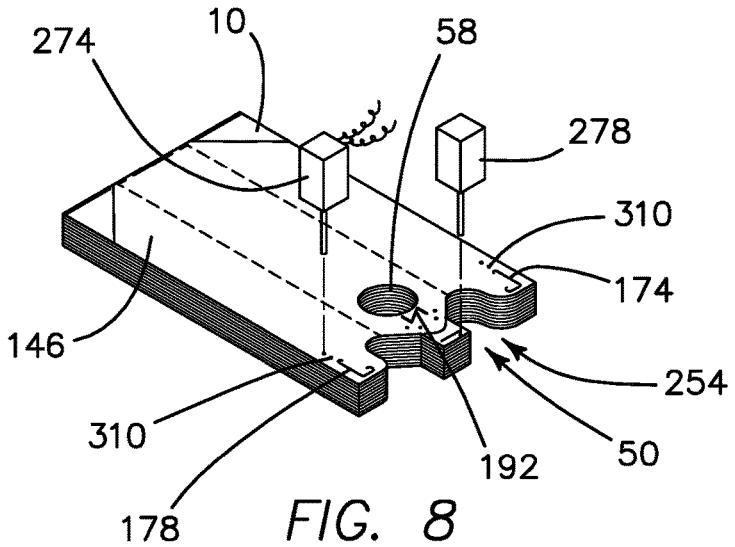
FIG. 8 is a perspective view of an apparatus for producing a wide mouth carryout bag pack illustrating hot pinning and cold staking attaching features.

(11) In still another variant, as illustrated in FIGS. 2, 8 and 11, the alignment feature 270 is selected from the group comprising: proprietary bag material formulations (not shown), hot pinning 274, cold staking 278, glue spotting 282, knife cutting (not shown), adhesive inks (not shown) and corona treatment with pressure (not shown).

(12) In a further variant, as illustrated in FIG. 11, the aperture maker 170 forms apertures 174, 178 including a first dispenser arm mounting aperture 298 and a second dispenser arm mounting aperture 302. The first aperture 298 penetrates the front 90 and rear 94 walls and the first side gusset 30 adjacent the first side edge 98 and the top edges 106 of the front 90 and rear 94 walls. The second aperture 302 penetrates the front 90 and rear 94 walls and the second side gusset 34 adjacent the second side edge 102 and the top edges 106 of the front 90 and rear 94 walls.

Figure 32:
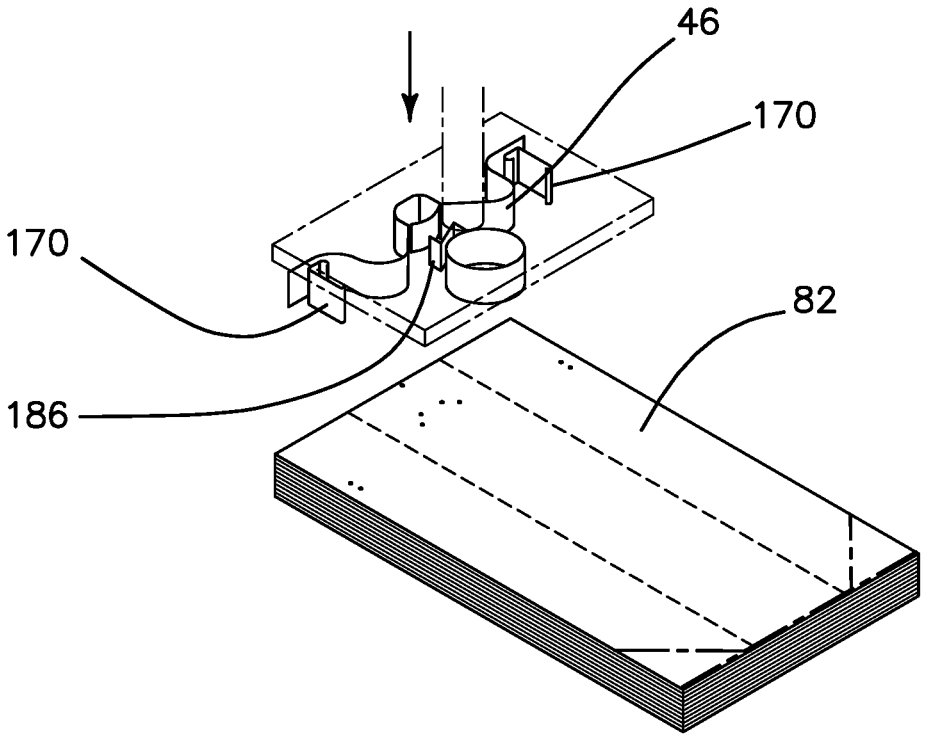
FIG. 32 is an enlarged, perspective view of an apparatus for forming a wide mouth carryout bag with a central, frangible mounting opening.
Figure 33:
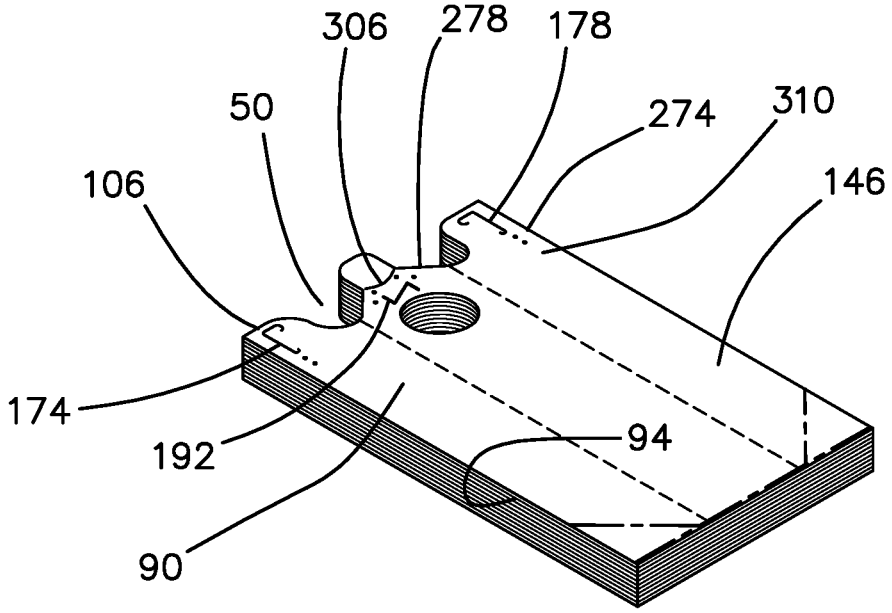
FIG. 33 is an enlarged, perspective view of a wide mouth carryout bag with a central, frangible mounting opening.

(13) In still a further variant, as illustrated in FIGS. 32 and 33, the die cutter 46 forms the bag mouth 50 with a central, frangible mounting opening 306. The central, frangible mounting opening 306 is centrally located in the front 90 and rear 94 walls adjacent the top edges 106 of the front 90 and rear 94 walls and is adapted to break apart with sufficient pressure from a force of removing the wide mouth carryout bag 146 from the dispensing rack 182, the central frangible mounting opening 306 remaining with the bag 146 when dispensed.

(14) In yet a further variant, as illustrated in FIGS. 2 and 33, at least one additional self-opening feature 310 is provided, the at least one additional self-opening feature 310 is selected from the group comprising: proprietary bag material formulations (not shown), hot pinning 274, cold staking 278, glue spotting 282, adhesive inks (not shown) and corona treatment with pressure 294.

(15) In another variant of the invention, the proprietary bag material formulations comprise 0.5 wt. % slip and antiblock compound.

(16) In still another variant, the proprietary bag material formulations comprise 1-3 wt. % calcium carbonate.

(17) In yet another variant, the proprietary bag material formulations comprise 10-20 wt. % recycled material, the recycled material comprising about 40-49 wt. % high density, high molecular weight polyethylene, 12-20 wt. % high density, medium molecular weight polyethylene, 20-30 wt. % linear low density polyethylene, 0-8 wt. % color concentrate.

(18) In a further variant, the proprietary bag material formulations wherein 10-15 wt. % of the linear low density polyethylene has a density ranging from 0.923-0.924 gm/cc.

(19) In still a further variant, the proprietary bag material formulations wherein 10-15 wt. % of the linear low density polyethylene has a melt index ranging from 0.25-0.30 gm/10 minutes.

(20) In yet a further variant, the proprietary bag material formulations wherein the high density, medium molecular weight polyethylene has a density ranging from 0.937-0.947 gm/cc.

(21) In another variant of the invention, the proprietary bag material formulations wherein the high density, medium molecular weight polyethylene has a melt index ranging from 0.10-0.30 gm/10 minutes.

(22) In still another variant, the at least one additional self-opening feature 310 is located adjacent the top edges 106 of the front 90 and rear 94 bag walls.

(23) In yet another variant, as illustrated in FIG. 9, the at least one additional self-opening feature 310 is located below the first 298 and second 302 apertures for suspending the bag pack 10 from the dispensing rack 182.

(24) In a further variant, as illustrated in FIGS. 2 and 28-31, the handle opening 58 is of the form selected from the group comprising round 314, oval 318, racetrack 322, kidney shaped 326 and elongated round 328.

(25) In still a further variant, as illustrated in FIG. 11, the dispensing rack 182 included a base 330. The base 330 is sized to accommodate a fully open wide mouth carryout bag 146. A central dispenser rack mounting hook 266 is provided. The central mounting hook 266 is attached to a central support (not shown) that extends upwardly from the base 330 and is adapted to position a pack of wide mouth carryout bags 10 above the base 330 using the central mounting tab 258. First 338 and second 342 side mounting arms are provided. The first 338 and second 342 side mounting arms are attached to the central support. The first 338 and second 342 side mounting arms are adapted to engage the first 298 and second 302 dispenser arm mounting apertures, position a pack of wide mouth carryout bags 10 above the base 330 and to maintain the bags 146 in an open position 346 for loading.

(26) In a final variant of the invention, as illustrated in FIG. 9, the dispensing rack 182 comprises a base 330. The base 330 is sized to accommodate a fully open wide mouth carryout bag 146. A central dispenser rack mounting hook 266 is provided. The central mounting hook 266 is attached to a central support 334 extending upwardly from the base 330 and adapted to position a pack of wide mouth carryout bags 10 above the base 330 using the central, frangible mounting opening 306. First 338 and second 342 side mounting arms are provided. The first 338 and second 342 side mounting arms are attached to the central support 334. The first 338 and second 342 side mounting arms are adapted to engage the first 298 and second 302 dispenser arm mounting apertures, position a pack of wide mouth carryout bags 10 above the base 330 and to maintain the bags 146 in an open position 346 for loading.

Figure 26:
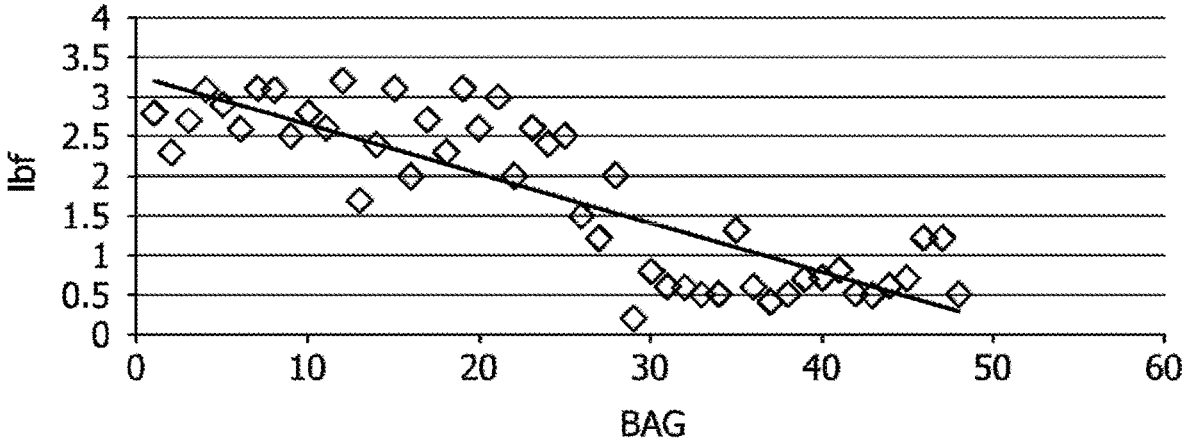
FIG. 26 is a graph illustrating the force applied to a subsequent bag by a leading bag in a bag pack of the Nguyen design.
Figure 27:
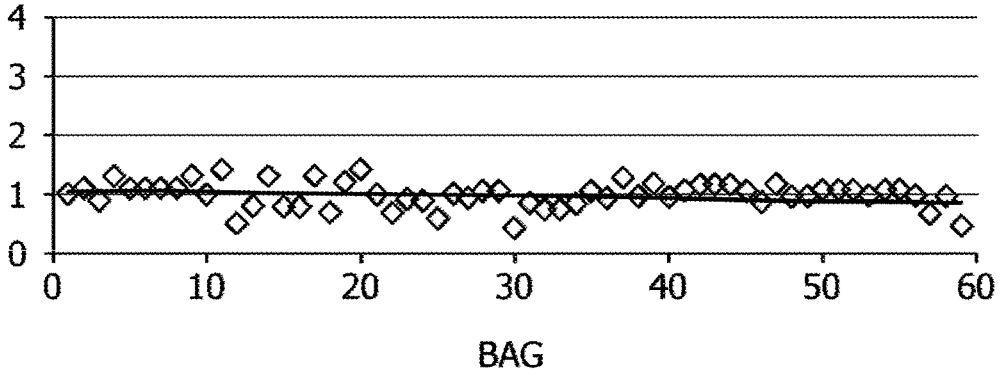
FIG. 27 is a graph illustrating the force applied to a subsequent bag by a leading bag in a bag pack of the design of the present invention.
Figure 28:
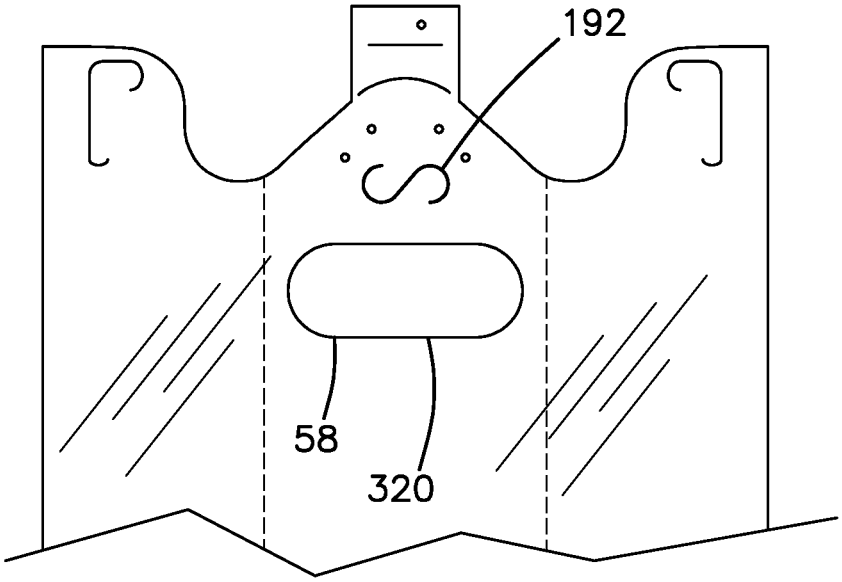
FIG. 28 is a plan view of the mouth portion of a wide mouth carryout bag illustrating a racetrack handle opening.
Figure 29:
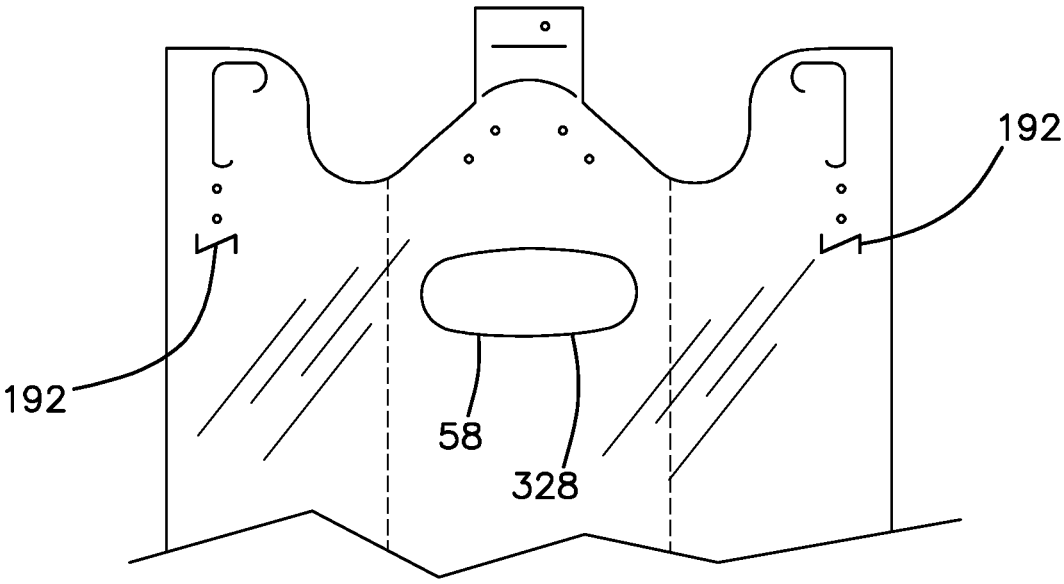
FIG. 29 is a plan view of the mouth portion of a wide mouth carryout bag illustrating an elongated rounded handle opening.
Figure 30:
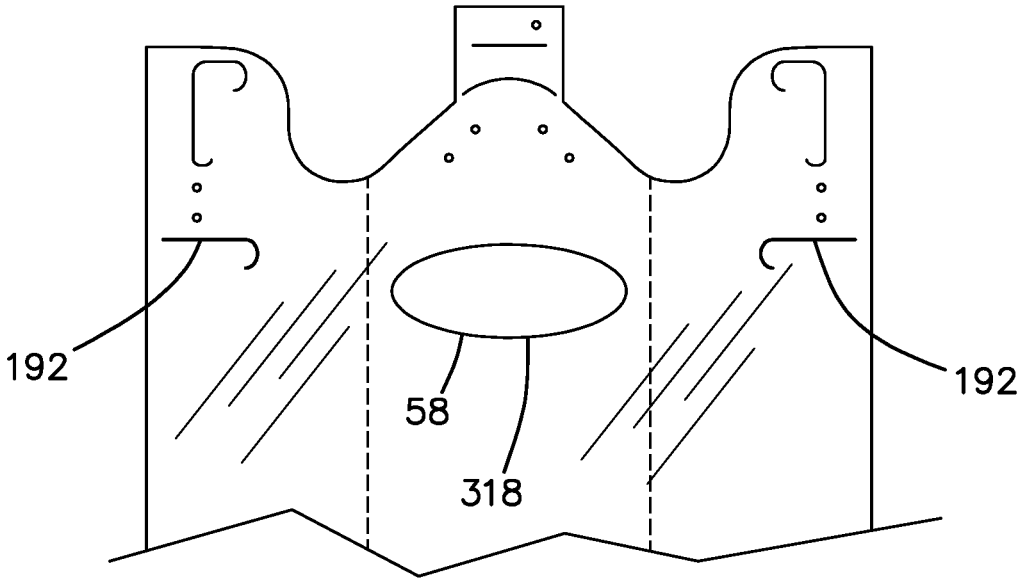
FIG. 30 is a plan view of the mouth portion of a wide mouth carryout bag illustrating an oval handle opening.
Figure 31:
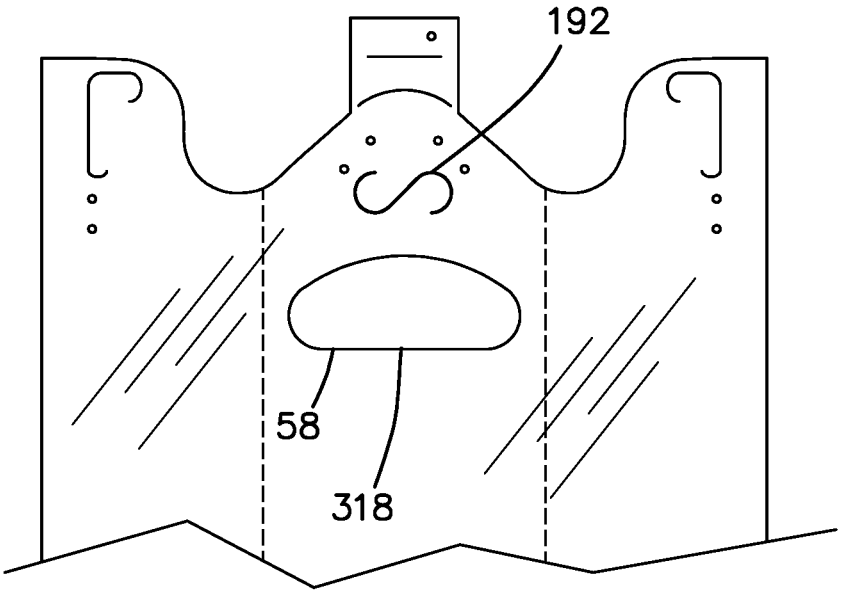
FIG. 31 is a plan view of the mouth portion of a wide mouth carryout bag illustrating a kidney-shaped handle opening.

As illustrated in FIGS. 26 and 27, the present invention is a significant inventive step over other self-opening bag packs. Rather than relying on the melding of bag surfaces together resulting from a blunt-tipped punch applied to the top of a corona-treated bag stack (Nguyen, U.S. Pat. No. 5,363,965), the present invention utilizes a uniform knife cut 192 that passes entirely through the bag pack 10. In the Nguyen design, the first few bags in the pack will adhere together with a certain force. As bags are removed from the stack, the adherence of one bag wall to the next will be diminished in proportion to the depth of each bag in the stack. The further the bag is from the top of the pack, the less will be the adherence of each bag to the one below it in the bag pack. The bags 146 of the present invention, as illustrated in FIGS. 10 and 11, are adhered together using an non-linear elongated cut 192 through the bag walls 90, 94 of the bags 146. In a given bag pack 10, the cut 192 extends from the first bag 146 in the pack 10 through the last. As it is the cut edges 204, 208 of the bag walls 90, 94 that are adhered together, and as the cuts 192 through each bag 146 in the bag pack 10 are uniform, the force to separate the first two bags 146 in the pack 10 will be substantially the same as the force to separate the last two bags 146 in the pack 10.

In order to objectively demonstrate this inventive step and the unexpected result associated with it the Applicant engaged Duncan Darby, Ph. D., Patricia Marconde and Jeffrey Weir of Clemson University, Center for Flexible Packaging (CEFPACK) to test the bags 146 of the present invention and bags of the Nguyen design with regards to the uniformity of force required to remove bags from the bag packs. As the Nguyen bag design has not proven to be a commercial success and is not generally available, the CEFPACK team had to construct bags of the Nguyen design. Fortunately, U.S. Pat. No. 5,363,965 provides detailed drawings of the types of punches used and the locations on the bags to which the punches are applied. The patent further describes the amount of pressure to be applied to the punch when forming the bag pack. The CEFPACK team acquired a punch of the design shown in FIGS. 9A and 9B of the '965 patent, constructed a press apparatus capable of providing 80-90 bar of pressure to the punch and applied the press to bag packs at locations 37", 38", 37' and 38' as per the '965 patent, using bags of the Nguyen design that lacked only the specified punches.

These bag packs were then mounted on a dispensing rack and a clip attached to a center point of an open portion of each bag. The clip was attached to a SATEC T-1000 universal testing machine with a cable type pulling assembly. The force in pounds required to pull the bags from the rack was recorded and graphed. A similar test was conducted using the knife cut bags 146 of the present invention.

As shown in FIG. 26, the force applied by a leading bag to a subsequent bag in the Nguyen design diminishes substantially as the bag pack is depleted. As can also be seen in FIG. 26, the force required to separate subsequent bags is highly variable. This sometimes results in failures of the subsequent bag to open or in the opening of multiple bags. As can be seen in FIG. 27, the force applied by a leading bag 146 to a subsequent bag 146 in the present invention stays substantially constant without regard to the position of a bag pair in the bag pack. This allows the bags 146 to be easily and uniformly opened with a lower force but with increased reliability. This ease of use and uniformity of release is the unexpected result that makes the present bag design a significant inventive step.

An appreciation of the other aims and objectives of the present invention and an understanding of it may be achieved by referring to the accompanying drawings and the detailed description of a preferred embodiment.

The invention claimed is:

1. An apparatus for making a self-opening wide mouth carryout bag pack comprising:

a supply of flexible film material;

an extruder, said extruder forming a continuous tube of film;

a folder, said folder folding in first and second side gussets;

a flattener, said flattener forming a continuous flattened tube;

a first sealer, said first sealer forming a bottom seal across a width of said flattened tube at a predetermined interval;

a cutter, said cutter cutting said flattened tube into bag blanks at a predetermined distance from said bottom seal;

said bag blanks having front and rear walls, first and second side edges, a top edge, a bottom edge and a mouth portion;

a second sealer, said second sealer forming a first angle seal, said first angle seal extending from said first side edge of said front and rear walls across said bottom seal at a point spaced outwardly from an innermost portion of said first side gusset at said bottom edges of said front and rear walls;

a third sealer, said third sealer forming a second angle seal, said second angle seal extending from said second side edge of said front and rear walls across said bottom seal at a point spaced outwardly from an innermost portion of said second side gusset at said bottom edges of said front and rear walls;

a stacker, said stacker forming said bag blanks into a bag pack with said top edges aligned;

a die cutter, said die cutter cutting a bag mouth orthogonal to a length of said flattened tube and cutting a handle opening adjacent said bag mouth;

said first and second angle seals creating a wide mouth carryout bag having a substantially flat bottom when said bag is opened, said flat bottom has three layers of material in the region formed from said first and second angle seals, said substantially flat bottom including two layers of bag material extending beyond said bottom seal;

an aperture maker, said aperture maker penetrating said bag pack and forming first and second apertures for suspending said bag pack from a dispensing rack;

an adhesion knife, said knife having a single non-linear elongated cutting edge and providing a single non-linear elongated knife cut, said single non-linear knife cut extending completely through front and rear walls of each of said bag blanks in said bag pack, having first and second ends and first and second elongated non-linear edges, and adhering adjacent bag blanks together in said bag pack along both of said first and second elongated non-linear edges and providing self-opening features; and wherein said bag pack is suspended from said dispensing rack and a first bag is pulled outwardly from said bag pack, said first and second edges of said knife cut in said front wall of a subsequent bag will be adhered to said edges of said knife cut in said rear wall of said first bag, thereby causing said first bag to open.

2. The apparatus for making a self-opening wide mouth carryout bag pack, as described in claim 1, wherein said first and second elongated non-linear edges of said knife cut are spaced apart by a distance ranging from 0.02 inches to 0.3 inches.

3. The apparatus for making a self-opening wide mouth carryout bag pack, as described in claim 1, wherein said knife cut is S-shaped.

4. The apparatus for making a self-opening wide mouth carryout bag pack, as described in claim 1, wherein said knife cut is Z-shaped.

5. The apparatus for making a self-opening wide mouth carryout bag pack, as described in claim 1, wherein said knife cut is in a form of a straight line, said straight line having at least one curved section at either of first and second ends of said straight line.

6. The apparatus for making a self-opening wide mouth carryout bag pack, as described in claim 1, further comprising a corona treater, said corona treater treating at least one of said front and rear walls, said corona treatment providing additional adhesion for printing ink on said bag walls.

7. The apparatus for making a self-opening wide mouth carryout bag pack as described in claim 1, further comprising a dual corona treater, said dual corona treater treating said front wall and said rear wall, thereby providing additional adhesion between adjacent bag in said bag pack and enhancing self-opening capability for said bag pack.

8. The apparatus for making a self-opening wide mouth carryout bag pack as described in claim 1, wherein said die cutter forms said bag mouth in a wave form.

9. The apparatus for making a self-opening wide mouth carryout bag pack as described in claim 1, wherein said die cutter forms said bag mouth with a central mounting tab, said central mounting tab has at least one mounting opening, said opening being sized and shaped to fit slidably over a central dispenser rack mounting hook, said central mounting tab being frangibly attached to said top edges of said front and rear walls above said handle opening.

10. The apparatus for making a self-opening wide mouth carryout bag pack as described in claim 9, wherein said central mounting tab further comprises an alignment feature, said alignment feature fastening said central mounting tab to a subsequent central mounting tab in said bag pack, thereby permitting easy mounting of said central mounting tabs to said dispensing rack.

11. The apparatus for making a self-opening wide mouth carryout bag pack as described in claim 10, wherein said alignment feature is selected from the group consisting of:

proprietary bag material formulations, hot pinning, cold staking, glue spotting, knife cutting, adhesive inks and corona treatment with pressure.

12. The apparatus for making a self-opening wide mouth carryout bag pack as described in claim 9, wherein said dispensing rack comprises:

a base, said base being sized to accommodate a fully open wide mouth carryout bag;

a central dispenser rack mounting hook, said central mounting hook attached to a central support extending upwardly from said base and adapted to position a pack of wide mouth carryout bags above said base using said central mounting tab; and first and second side mounting arms, said first and second side mounting arms being attached to said central support, said first and second side mounting arms adapted to engage first and second dispenser arm mounting apertures, position a pack of wide mouth carryout bags above said base and to maintain said bags in an open position for loading.

13. The apparatus for making a self-opening wide mouth carryout bag pack as described in claim 1, wherein said aperture maker forms apertures comprising:

a first dispenser arm mounting aperture, said first aperture penetrating said front and rear walls and said first side gusset adjacent said first side edge and said top edges of said front and rear walls; and a second dispenser arm mounting aperture, said second aperture penetrating said front and rear walls and said second side gusset adjacent said second side edge and said top edges of said front and rear walls.

14. The apparatus for making a self-opening wide mouth carryout bag pack as described in claim 13, wherein said die cutter forms said bag mouth with a central, frangible mounting opening, said central, frangible mounting opening being centrally located in said front and rear walls adjacent said top edges of said front and rear walls and being adapted to break apart with sufficient pressure from a force of removing said wide mouth carryout bag from said dispensing rack, said central frangible mounting opening remaining with said bag when dispensed.

15. The apparatus for making a self-opening wide mouth carryout bag pack as described in claim 14, wherein said dispensing rack comprises:

a base, said base being sized to accommodate a fully open wide mouth carryout bag;

a central dispenser rack mounting hook, said central mounting hook attached to a central support extending upwardly from said base and adapted to position a pack of wide mouth carryout bags above said base using said central, frangible mounting opening; and first and second side mounting arms, said first and second side mounting arms being attached to said central support, said first and second side mounting arms adapted to engage first and second dispenser arm mounting apertures, position a pack of wide mouth carryout bags above said base and to maintain said bags in an open position for loading.

16. The apparatus for making a self-opening wide mouth carryout bag pack as described in claim 1, further comprising at least one additional self-opening feature selected from the group consisting of:

proprietary bag material formulations, hot pinning, cold staking, glue spotting, adhesive inks and corona treatment with pressure.

17. The apparatus for making a self-opening wide mouth carryout bag pack as described in claim 16 wherein the proprietary bag material formulations comprise 0.5 wt. % slip and antiblock compound.

18. The apparatus for making a self-opening wide mouth carryout bag pack as described in claim 16 wherein the proprietary bag material formulations comprise 1-3 wt. % calcium carbonate.

19. The apparatus for making a self-opening wide mouth carryout bag pack as described in claim 16 wherein the proprietary bag material formulations comprise 10-20 wt. % recycled material, said recycled material comprising about 40-49 wt. % high density, high molecular weight polyethylene, 12-20 wt. % high density, medium molecular weight polyethylene, 20-30 wt. % linear low density polyethylene, 0-8 wt. % color concentrate.

20. The apparatus for making a self-opening wide mouth carryout bag pack as described in claim 16 wherein the proprietary bag material formulations wherein 10-15 wt. % of said linear low density polyethylene has a density ranging from 0.923-0.924 gm/cc.

21. The apparatus for making a self-opening wide mouth carryout bag pack as described in claim 16 wherein the proprietary bag material formulations wherein 10-15 wt. % of said linear low density polyethylene has a melt index ranging from 0.25-0.30 gm/10 minutes.

22. The apparatus for making a self-opening wide mouth carryout bag pack as described in claim 16 wherein the proprietary bag material formulations wherein said high density, medium molecular weight polyethylene has a density ranging from 0.937-0.947 gm/cc.

23. The apparatus for making a self-opening wide mouth carryout bag pack as described in claim 16 wherein the proprietary bag material formulations wherein said high density, medium molecular weight polyethylene has a melt index ranging from 0.10-0.30 gm/10 minutes.

24. The apparatus for making a self-opening wide mouth carryout bag pack as described in claim 16 wherein said at least one additional self-opening feature is located adjacent said top edges of said front and rear bag walls.

25. The apparatus for making a self-opening wide mouth carryout bag pack as described in claim 16 wherein said at least one additional self-opening feature is located below said first and second apertures for suspending said bag pack from said dispensing rack.

26. The apparatus for making a self-opening wide mouth carryout bag pack as described in claim 1, wherein said handle opening is of a form selected from the group consisting of:

round, oval, racetrack, and kidney shaped and elongated round.

27. A method of making a self-opening wide mouth carryout bag pack using the apparatus of claim 1, comprising steps of:

providing a supply of flexible film material;

extruding, using said extruder, a continuous tube of film;

folding in first and second side gussets;

flattening said continuous tube;

forming a bottom seal across a width of said flattened tube at a predetermined interval;

cutting said flattened tube into bag blanks at a predetermined distance from said bottom seal;

said bag blanks has front and rear walls, first and second side edges, a top edge, a bottom edge and a mouth portion;

forming a first angle seal, said first angle seal extending from said first side edge of said front and rear walls across said bottom seal at a point spaced outwardly from an innermost portion of said first side gusset at said bottom edges of said front and rear walls;

forming a second angle seal, said second angle seal extending from said second side edge of said front and rear walls across said bottom seal at a point spaced outwardly from an innermost portion of said second side gusset at said bottom edges of said front and rear walls;

stacking said bag blanks into a bag pack with said bag mouths aligned;

die cutting a bag mouth orthogonal to a length of said tube and cutting a handle opening adjacent said bag mouth;

said first and second angle seals causing said bag to have a substantially flat bottom when said wide mouth carryout bag is opened, said flat bottom has three layers of material in the region formed from said first and second angle seals, said substantially flat bottom including two layers of bag material extending beyond said bottom seal;

forming first and second apertures penetrating said bag pack for suspending said bag pack from a dispensing rack;

penetrating said bag pack with an adhesion knife, an adhesion knife, said knife having a single non-linear elongated cutting edge and providing a single non-linear elongated knife cut, said single non-linear knife cut extending completely through front and rear walls of each of said bag blanks in said bag pack, having first and second ends and first and second elongated non-linear edges, and adhering adjacent bag blanks together in said bag pack along both of said first and second elongated non-linear edges and providing self-opening features;

wherein said bag pack is suspended from said dispensing rack and a first bag is pulled outwardly from said bag pack, said first and second edges of said knife cut in said front wall of a subsequent bag will be adhered to said first and second edges of said knife cut in said rear wall of said first bag, thereby causing said first bag to open.

28. The method of making a self-opening wide mouth carryout bag pack, as described in claim 27, wherein said first and second elongated non-linear edges of said knife cut are spaced apart by a distance ranging from 0.02 inches to 0.3 inches.

29. The method of making a self-opening wide mouth carryout bag pack, as described in claim 27, wherein said knife cut is S-shaped.

30. The method of making a self-opening wide mouth carryout bag pack, as described in claim 27, wherein said knife cut is Z-shaped.

31. The method of making a self-opening wide mouth carryout bag pack, as described in claim 27, wherein said knife cut is in a form of a straight line, said straight line having at least one curved section at either of first and second ends of said straight line.

32. The method of making a self-opening wide mouth carryout bag pack, as described in claim 27, further comprising a step of corona treating at least one of said front and rear walls, said corona treatment providing additional adhesion for printing ink on said bag walls.

33. The method of making a self-opening wide mouth carryout bag pack as described in claim 27, further comprising a step of using a dual corona treater for treating said front wall and said rear wall, thereby providing additional adhesion between adjacent bag in said bag pack and enhancing self-opening capability for said bag pack.

34. The method of making a self-opening wide mouth carryout bag pack as described in claim 27, further comprising a step of using said die cutter to form said bag mouth in a wave form.

35. The method of making a self-opening wide mouth carryout bag pack as described in claim 27, further comprising a step of using said die cutter to form said bag mouth with a central mounting tab, said central mounting tab has at least one mounting opening, said opening being sized and shaped to fit slidably over a central dispenser rack mounting hook, said central mounting tab being frangibly attached to said top edges of said front and rear walls above said handle opening.

36. The method of making a self-opening wide mouth carryout bag pack as described in claim 35, further comprising a step of forming said central mounting tab with an alignment feature, said alignment feature fastening said central mounting tab to a subsequent central mounting tab in said bag pack, thereby permitting easy mounting of said central mounting tabs to said dispensing rack.

37. The method of making a self-opening wide mouth carryout bag pack as described in claim 36, wherein said alignment feature is selected from the group consisting of:

proprietary bag material formulations, hot pinning, cold staking, glue spotting, knife cutting, adhesive inks and corona treatment with pressure.

38. The method of making a self-opening wide mouth carryout bag pack as described in claim 35, further comprising a step of providing said dispensing rack comprising:

a base, said base being sized to accommodate a fully open wide mouth carryout bag;

a central dispenser rack mounting hook, said central mounting hook attached to a central support extending upwardly from said base and adapted to position a pack of wide mouth carryout bags above said base using said central mounting tab; and first and second side mounting arms, said first and second side mounting arms being attached to said central support, said first and second side mounting arms adapted to engage first and second dispenser arm mounting apertures, position a pack of wide mouth carryout bags above said base and to maintain said bags in an open position for loading.

39. The method of making a self-opening wide mouth carryout bag pack as described in claim 27, further comprising steps of forming apertures comprising:

a first dispenser arm mounting aperture, said first aperture penetrating said front and rear walls and said first side gusset adjacent said first side edge and said top edges of said front and rear walls; and a second dispenser arm mounting aperture, said second aperture penetrating said front and rear walls and said second side gusset adjacent said second side edge and said top edges of said front and rear walls.

40. The method of making a self-opening wide mouth carryout bag pack as described in claim 39, further comprising a step of forming said bag mouth with a central, frangible mounting opening, said central, frangible mounting opening being centrally located in said front and rear walls adjacent said top edges of said front and rear walls and being adapted to break apart with sufficient pressure from a force of removing said wide mouth carryout bag from said dispensing rack, said central frangible mounting opening remaining with said bag when dispensed.

41. The apparatus for making a self-opening wide mouth carryout bag pack as described in claim 40, further comprising a step of providing said dispensing rack comprising:

a base, said base being sized to accommodate a fully open wide mouth carryout bag;

a central dispenser rack mounting hook, said central mounting hook attached to a central support extending upwardly from said base and adapted to position a pack of wide mouth carryout bags above said base using said central, frangible mounting opening; and first and second side mounting arms, said first and second side mounting arms being attached to said central support, said first and second side mounting arms adapted to engage first and second dispenser arm mounting apertures, position a pack of wide mouth carryout bags above said base and to maintain said bags in an open position for loading.

42. The method of making a self-opening wide mouth carryout bag pack as described in claim 27, further comprising a step of providing at least one additional self-opening feature selected from the group comprising:

proprietary bag material formulations, hot pinning, cold staking, glue spotting, adhesive inks and corona treatment with pressure.

43. The method of making a self-opening wide mouth carryout bag pack as described in claim 42 wherein the proprietary bag material formulations comprise 0.5 wt. % slip and antiblock compound.

44. The method of making a self-opening wide mouth carryout bag pack as described in claim 42 wherein the proprietary bag material formulations comprise 1-3 wt. % calcium carbonate.

45. The method of making a self-opening wide mouth carryout bag pack as described in claim 42 wherein the proprietary bag material formulations comprise 10-20 wt. % recycled material, said recycled material comprising about 40-49 wt. % high density, high molecular weight polyethylene, 12-20 wt. % high density, medium molecular weight polyethylene, 20-30 wt. % linear low density polyethylene, 0-8 wt. % color concentrate.

46. The method of making a self-opening wide mouth carryout bag pack as described in claim 42 wherein the proprietary bag material formulations wherein 10-15 wt. % of said linear low density polyethylene has a density ranging from 0.923-0.924 gm/cc.

47. The method of making a self-opening wide mouth carryout bag pack as described in claim 42 wherein the proprietary bag material formulations wherein 10-15 wt. % of said linear low density polyethylene has a melt index ranging from 0.25-0.30 gm/10 minutes.

48. The method of making a self-opening wide mouth carryout bag pack as described in claim 42 wherein the proprietary bag material formulations wherein said high density, medium molecular weight polyethylene has a density ranging from 0.937-0.947 gm/cc.

49. The method of making a self-opening wide mouth carryout bag pack as described in claim 42 wherein the proprietary bag material formulations wherein said high density, medium molecular weight polyethylene has a melt index ranging from 0.10-0.30 gm/10 minutes.

50. The method of making a self-opening wide mouth carryout bag pack as described in claim 42 further comprising a step of disposing said at least one additional self-opening feature adjacent said top edges of said front and rear bag walls.

51. The method of making a self-opening wide mouth carryout bag pack as described in claim 42 further comprising a step of disposing said at least one additional self-opening feature below said first and second apertures for suspending said bag pack from said dispensing rack.

52. The method of making a self-opening wide mouth carryout bag pack as described in claim 27, further comprising a step of forming said handle opening in a form selected from the group consisting of:

round, oval, racetrack and kidney shaped.

* * * * *